US006882327B2

(12) United States Patent
Mizobata

(10) Patent No.: US 6,882,327 B2
(45) Date of Patent: Apr. 19, 2005

(54) PLASMA DISPLAY PANEL WITH NUMBER OF SCANNING DRIVERS REDUCED BY USING PROGRESSIVE DRIVE METHOD

(75) Inventor: Eishi Mizobata, Tokyo (JP)

(73) Assignee: Pioneer Plasma Display Corporation, Izumi (JP)

( * ) Notice: Subject to any disclaimer, the term of this patent is extended or adjusted under 35 U.S.C. 154(b) by 341 days.

(21) Appl. No.: 10/028,237

(22) Filed: Dec. 21, 2001

(65) Prior Publication Data

US 2002/0070908 A1 Jun. 13, 2002

(30) Foreign Application Priority Data

Dec. 21, 2000 (JP) ..... 2000-388882

(51) Int. Cl.[7] ..... G09G 3/20
(52) U.S. Cl. ..... 345/60; 345/67; 315/169.4
(58) Field of Search ..... 345/60–72; 315/169.1–169.4

(56) References Cited

U.S. PATENT DOCUMENTS 6,097,358 A * 8/2000 Hirakawa et al. ..... 345/63
6,118,416 A * 9/2000 Nakamura et al. ..... 345/68
6,373,452 B1 * 4/2002 Ishii et al. ..... 345/67

FOREIGN PATENT DOCUMENTS

EP 0 762 373 3/1997
EP 0 938 072 8/1999
JP 05-002993 1/1993
JP 6-44907 2/1994
JP 09-160525 6/1997
JP 9-244573 9/1997

OTHER PUBLICATIONS

"Cell Structure and Driving Method of a 25–In. (64CM) Diagonal High Resolution Color AC Plasma Display" (1998).

* cited by examiner

*Primary Examiner*—Amr A. Awad
(74) *Attorney, Agent, or Firm*—Morgan, Lewis & Bockius LLP

(57) ABSTRACT

The number of X electrodes of a PDP to be driven is m, the number of Y electrodes of the same is m+1, and they are alternately disposed at equal intervals. The intersections (2m−1) between all the X electrodes and Y electrodes and the data electrodes (n) form each cell, and a total of (2m−1)×n pixels exist. Wall charges with the same polarity and the same amount are formed on the X electrode and Y electrode within one cell while surface discharge occurs between the X electrode and Y electrode, and lighting and non-lighting is distinguished based on the wall charge amount. The surface discharge is set so as not to occur when either the X electrodes or Y electrodes only change their voltages.

125 Claims, 22 Drawing Sheets

PLASMA DISPLAY PANEL WITH NUMBER OF SCANNING DRIVERS REDUCED BY USING PROGRESSIVE DRIVE METHOD

BACKGROUND OF THE INVENTION

1. Field of the Invention

The present invention relates to a plasma display panel and a drive method for the same.

2. Description of the Related Art

Generally, a plasma display panel (hereinafter, abbreviated to PDP) has many advantages whereby a thin and large screen display can be easily realized, the angle of view is wide, and the response speed is high. Therefore, recently, PDPs have been used as flat displays in the forms of wall-hung televisions, public bulletin boards and the like. PDPs are divided by operation methods into a direct current discharge type (DC type) to be operated in a direct current discharge condition where electrodes are exposed to a discharge space (discharge gas), and an alternating current discharge type (AC type) to be operated in an alternating current discharge condition where electrodes are coated with dielectrics and prevented from being directly exposed in a discharge gas.

In the DC type, discharge occurs during a period in which a voltage is applied, and in the AC type, discharge is continued by inverting the polarity of a voltage. Furthermore, the AC type is divided into two types, a type having two electrodes in one cell and a type having three electrodes in one cell.

Herein, the structure of the conventional 3-electrode AC type plasma display panel and a drive method therefor are explained. FIG. 2 is a cell sectional view showing an example of the conventional plasma display panel.

The 3-electrode AC type plasma display panel comprises front substrate 20 and back substrate 21 which are opposed to each other, a plurality of X electrodes 22 and Y electrodes 23, and data electrodes 29 disposed between the substrates 20 and 21, display cells disposed in a matrix form at intersections between the X electrodes 22 and Y electrodes 23 and the data electrodes 29.

A glass plate or the like is used for the front substrate 20, and the X electrodes 22 and Y electrodes 23 are provided at predetermined intervals. Metal electrodes 32 are laminated on the X electrodes 22 and Y electrodes 23 to lower wiring resistances. On these electrodes, transparent dielectric layer 24 and protective layer 25 made from MgO or the like for protecting the transparent dielectric layer 24 from discharge are formed. Meanwhile, a glass plate is used for the back substrate 21, and data electrodes 29 are provided so as to be orthogonal to the X electrodes 22 and Y electrodes 23. Furthermore, on the data electrode 29, white dielectric layer 28 and fluorescent layer 27 are provided. Between the two glass substrates, partitions are formed in parallel to the paper surface at predetermined intervals. The partitions form discharge spaces and partition or define pixels. Within the discharge space 26, a mixed gas of He, Ne, Xe, and the like is sealed. Such a structure is mentioned in "Society for Information Display 98 Digest", p. 279–281, May 1998.

FIG. 1 shows a plan view of the conventional 3-electrode AC type plasma display panel. At intersections between Xi of X electrodes 22 and Yi of Y electrodes 23 (i=1 through m) and Dj of data electrodes 29 (j=1 through n), display cells 31 are arranged in a matrix form.

Next, a method for driving the PDP is explained. The current mainstream provides an address display separation method (ADS method) in which scanning periods and sustaining periods are separated. Hereinafter, a drive method for this ADS method is explained. FIG. 3 shows an example of a drive waveform diagram of one subfield (hereinafter, abbreviated to SF) 1 of the 3-electrode AC type plasma display panel. One subfield 1 is composed of three periods, that is, preliminary discharge period 2, scanning period 3, and sustaining period 4.

First, the preliminary discharge period 2 is explained. A negative preliminary discharge pulse 6 is applied to the X electrode 22, and a positive preliminary discharge pulse 5 is applied to the Y electrode 23. Thereby, a difference in formation of wall charges at the final point of the previous SF due to the emission condition of the previous SF is reset and initialized, and at the same time, all pixels are forcibly discharged, and a priming effect for subsequent writing discharge at a low voltage is obtained. In FIG. 3, each of the positive and negative preliminary discharge pulses 5 and 6 is generated once, however, each pulse may be divided to perform two roles so that a sustaining eliminating pulse for resetting the previous SF condition is applied, and thereafter a priming pulse for generating a priming effect by discharging all pixels is applied. At this time, the number of sustaining eliminating pulses is not limited to one, and different pulses may be applied several times. The priming effect is not required for each SF, there is also a method in which a priming pulse is applied only once per several SFs. The priming pulse causes all pixels to emit light regardless of displays. Therefore, by reducing the number of priming pulses to be applied, luminance for a black display can be suppressed to be low. As in the conventional example of FIG. 3, when the preliminary discharge pulses 5 and 6 are used, in order to set the priming effect for forcibly discharging all pixels so as to be once per several SFs, the preliminary discharge pulses 5 and 6 may be lowered in the SFs other than in FIG. 3 so as to perform only resetting. At this time, in order to make resetting secure, different pulses may be applied several times in place of the preliminary discharge pulses.

Next, the period enters the scanning period 3. In the scanning period 3, scanning pulses 7 are applied to the X1 through Xm of the X electrodes 22 in order. In accordance with the scanning pulses 7, data pulses 9 are applied to D1 through Dn of the data electrodes 29 in accordance with the display patterns. In a pixel to which the data pulse 9 has been applied, a high voltage is applied between the X electrode 22 and data electrode 29, so that writing discharge occurs, a great positive wall charge is formed at the X electrode 22 side, and a negative wall charge is formed at the data electrode 29 side. On the other hand, in a pixel to which the data pulse 9 has not been applied, the applied voltage is low, so that discharge does not occur, and the status of the wall charge does not change. Thus, depending on the existence of the data pulse 9, two statuses of wall charges can be created. The diagonal lines of the data pulses 9 in the Figure indicate that the existence of the data pulse 9 changes in accordance with display data.

When application of the scanning pulses 7 to all lines is finished, the period enters the sustaining period 4. Sustaining pulses 10 are alternately applied to all X electrodes 22 and all Y electrodes 23. The voltage values of the sustaining pulses 10 are set so as not to cause discharge by themselves. Therefore, in a pixel without occurrence of writing discharge, wall charge is little, so that discharge does not occur even when a sustaining pulse is applied. On the other hand, in a pixel in which writing discharge has been occurred, a great positive wall charge exists at the X electrode 22 side, this positive wall charge is superposed on the first positive sustaining pulse (referred to as a first sustaining pulse) applied to the X electrode 22 and, a voltage higher than the discharge starting voltage is applied to the discharge space, whereby sustaining discharge occurs. Due to this discharge, negative wall charges are accumulated at the X electrode 22 side, and positive wall charges are accumulated at the Y electrode 23 side. The next sustaining pulse (referred to as a second sustaining pulse) is applied to the Y electrode 23 side, and in response to superposition of the wall charge, sustaining discharge also occurs herein, and wall charges with a polarity opposite to that of the first sustaining pulse are accumulated at the X electrode 22 side and Y electrode 23 side. Thereafter, discharge still continuously occurs based on the same principle. That is, a potential difference caused by a wall charge generated due to the x-th sustaining discharge is superposed on the x+1-th sustaining pulse and the sustaining discharge is continued. A light emission amount is determined by the number of sustaining discharge continuance.

The whole of the abovementioned sustaining eliminating period 2, scanning period 3, and sustaining period 4 is referred to as a subfield. When gradation display is carried out, one field which is a period for displaying image information for one screen is comprised of a plurality of subfields. Gradation display can be achieved by changing the number of sustaining pulses of each subfield and turning each subfield on/off.

Thus, a display screen with m lines is driven in a progressive (non-interlace) manner by using m of X electrode drivers and one Y electrode driver.

However, in the abovementioned structure and drive method, non-discharge gap 38 which is the interval between the X electrode and the Y electrode in the next cell must be larger than the discharge gap 37, and this is not suitable for highly fine panels. Therefore, as generally known examples of a panel structure and a drive method suitable for high fineness, there are a plasma display panel drive method and a plasma display panel device described in Japanese Unexamined Patent Publication No. 160525 of 1997.

FIG. 4 shows a plan view of the panel. The points of difference from the conventional panel of FIG. 1 are that one Y electrode is added to the upper part, and all X and Y electrodes are disposed at equal intervals. In this conventional example of FIG. 4, the electrode gaps between all X and Y electrodes are pixels, and this can cope with highly fine screens.

FIG. 5 and FIG. 6 show the drive method. FIG. 5 shows a drive waveform of an odd-numbered field of the conventional example of FIG. 4. FIG. 6 shows a drive waveform of an even-numbered field of the conventional example of FIG. 4. The preliminary discharge period 2 is the same as in the conventional example of FIG. 3. Next, the scanning period 3 is entered. In the scanning period 3, scanning pulses 7 are applied to X1 through Xm of X electrodes 22 in order.

Data pulses 9 are applied in response to the scanning pulses 7 to D1 through Dn of the data electrodes 29 in accordance with display patterns. The method for applying the data pulses 9 at this time is shown in FIG. 7. In FIG. 7, Y1 to X3 on a certain data electrode of FIG. 4 are arranged horizontally. In the example of FIG. 7, a case of display by turning on and off is shown as in the upper part of the Figure. This drive method is interlace drive, so that the first, third, and fifth pixels in order from the left are caused to display in an odd-numbered field, and the second and fourth pixels are caused to display in an even-numbered field.

First, the case of an odd-numbered field is explained. Among the first, third, and fifth pixels, only the first pixel is a lighting pixel. Therefore, only when a scanning pulse 13 is applied to X1 which is the X electrode 22 of the first pixel, a data pulse 9 is applied. When application of scanning pulses 8 to all lines is finished, the period enters the sustaining period 4. In the odd-numbered field, odd-numbered X electrodes and even-numbered Y electrodes have the same phase, and even-numbered X electrodes and odd-numbered Y electrodes have the same phase. Thereby, in a pixel in which wall charge has been formed in the scanning period, sustaining discharge occurs between the odd-numbered X electrodes and even-numbered Y electrodes and between the even-numbered X electrodes and odd-numbered Y electrodes. In the conventional example of FIG. 7, sustaining discharge does not occur during the first sustaining, however, sustaining discharge occurs from the second sustaining, and thereafter, sustaining discharge is continued. If a wall charge is not formed in the scanning period, sustaining discharge occurs in neither of the odd-numbered fields and even-numbered fields.

Next, the case of an even-numbered field is explained. The second and fourth pixels are lighting pixels, so that data pulses 9 are applied both when a scanning pulse 13 is applied to X1 which is the X electrode 22 of the second pixel and when a scanning pulse 13 is applied to X2 which is the X electrode 22 of the fourth pixel. When application of scanning pulses 13 to all lines is finished, the period enters sustaining period 4. In an even-numbered field, odd-numbered X electrodes and odd-numbered Y electrodes have the same phase, and even-numbered X electrodes and even-numbered Y electrodes have the same phase. Thereby, in a pixel in which a wall charge has been formed in the scanning period, sustaining discharge occurs between the odd-numbered X electrodes and odd-numbered Y electrodes and between the even-numbered X electrodes and even-numbered Y electrodes. Also herein, in the second pixel, sustaining discharge does not occur during the first sustaining, however, as the odd-numbered field, sustaining discharge starts from the second sustaining and is continued thereafter.

As mentioned above, if the two odd-numbered and even-numbered fields are joined together, display can be carried out between all X electrodes and Y electrodes, so that a highly fine display can be realized.

Thus, by using m of X electrode drivers and two of Y electrode drivers, a display screen with 2 m lines which is two times the lines of the conventional example can be displayed. However, in this case, interlace drive is employed.

However, the number of scanning lines increases for realizing a highly fine panel. Accordingly, the number of scanning drivers also increases, and production costs increase. On the other hand, as shown in the prior art, a method may be used in which interlace drive is employed and the number of scanning drivers can be reduced. However, image quality deteriorates due to interlace drive.

SUMMARY OF THE INVENTION

The object of the invention is to provide a plasma display panel and a drive method therefor wherein the number of scanning drivers or the total number of X electrode drivers and Y electrode drivers can be reduced by employing progressive (non-interlace) drive.

A plasma display panel (PDP) of the invention is an AC type plasma display panel (PDP) wherein, a plurality of X electrodes and a plurality of Y electrodes are alternately arranged in parallel to each other on one of two insulating substrates opposed to each other, and a plurality of data electrodes are arranged on the other insulating substrate so as to be orthogonal to the X electrodes and Y electrodes, a gap between an X electrode and Y electrode adjacent to the X electrode is formed as a discharge gap, and a gap between the X electrode and another Y electrode adjacent to the X electrode is formed as a non-discharge gap, pixels arranged in a matrix form are disposed at intersections between the discharge gaps and data electrodes, and every several X electrodes and every several Y electrodes are made to share a driver each. To drive the abovementioned PDP, when writing to each pixel to form wall charges, by writing the same amount of wall charge into the X electrode and Y electrode in one pixel, lighting and non-lighting may be controlled depending on the wall charge amounts. Furthermore, to drive the PDP, when writing to form wall charges in each pixel based on display data, wall charges may be written by making the potentials of the X electrode and Y electrode in one pixel equal to each other, and lighting and non-lighting may be controlled based on the wall charge amount. Furthermore, to drive the PDP, when writing to form wall charges in each pixel based on display data, the voltages of the wall charges formed in the X electrode and Y electrode within one pixel mentioned above may be set to a level at which surface discharge does not occur between the X electrodes and Y electrodes even if the sustaining pulse voltages are joined together.

The PDP according to the invention may be an AC type plasma display panel (PDP) constructed so that a plurality of X electrodes and a plurality of Y electrodes are alternately arranged in parallel to each other on one of two insulating substrates opposed to each other, a plurality of data electrodes are arranged on the other insulating substrate so as to be orthogonal to the X electrodes and Y electrodes, all gaps between the X electrodes and Y electrodes are formed as discharge gaps, and pixels arranged in a matrix form are formed at intersections between the discharge gaps and data electrodes, means for dividing surface discharge between the X electrode and Y electrode at the boundaries between the electrodes and adjacent pixels in the data electrode direction are provided on the X electrodes and Y electrodes, and either every several X electrodes or Y electrodes are made to share a driver. To drive this PDP, when writing and forming wall charges into each pixel based on display data, the same amount of wall charge is written into the X electrode and Y electrode within one pixel, and lighting and non-lighting of the pixel may be controlled depending on the wall charge amounts. Furthermore, to drive this PDP, when writing and forming wall charges in each pixel based on display data, wall charges may be written by setting the potentials of the X electrode and Y electrode within one pixel to be equal to each other, and lighting and non-lighting of the pixel may be controlled depending on the wall charge amounts. Furthermore, to drive this PDP, when writing and forming wall charges in each pixel based on display data, the voltages of wall charges to be formed in the X electrode and Y electrode within one pixel may be set to be a voltage at which surface discharge does not occur between the X electrode and Y electrode even if the sustaining pulse voltage is added to them.

The plasma display panel of the invention is an AC type plasma display in which a plurality of X electrodes and a plurality of Y electrodes are alternately arranged in parallel to each other on one of two insulating substrates opposed to each other, a plurality of data electrodes are arranged on the other insulating substrate so as to be orthogonal to the X electrodes and Y electrodes, all gaps between the X electrodes and Y electrodes are formed as discharge gaps, pixels arranged in a matrix form are disposed at intersections between the discharge gaps and data electrodes, means for dividing surface discharge between the X electrodes and Y electrodes at the boundaries between the electrodes and adjacent pixels in the data electrode direction are provided on the X electrodes and Y electrodes, and either every several X electrodes or Y electrodes are made to share a driver. Furthermore, in this panel, the means for dividing surface discharge between X electrodes and Y electrodes at boundaries between the electrodes and adjacent pixels in the data electrode direction, which are provided on X electrodes and Y electrodes, are cell partitions which are provided on the insulating substrate with the X electrodes and Y electrodes so as to be along the X electrodes and Y electrodes.

DETAILED DESCRIPTION OF THE PREFERRED EMBODIMENTS

Hereinafter, embodiments of the invention are explained with reference to the drawings.

Figure 4:
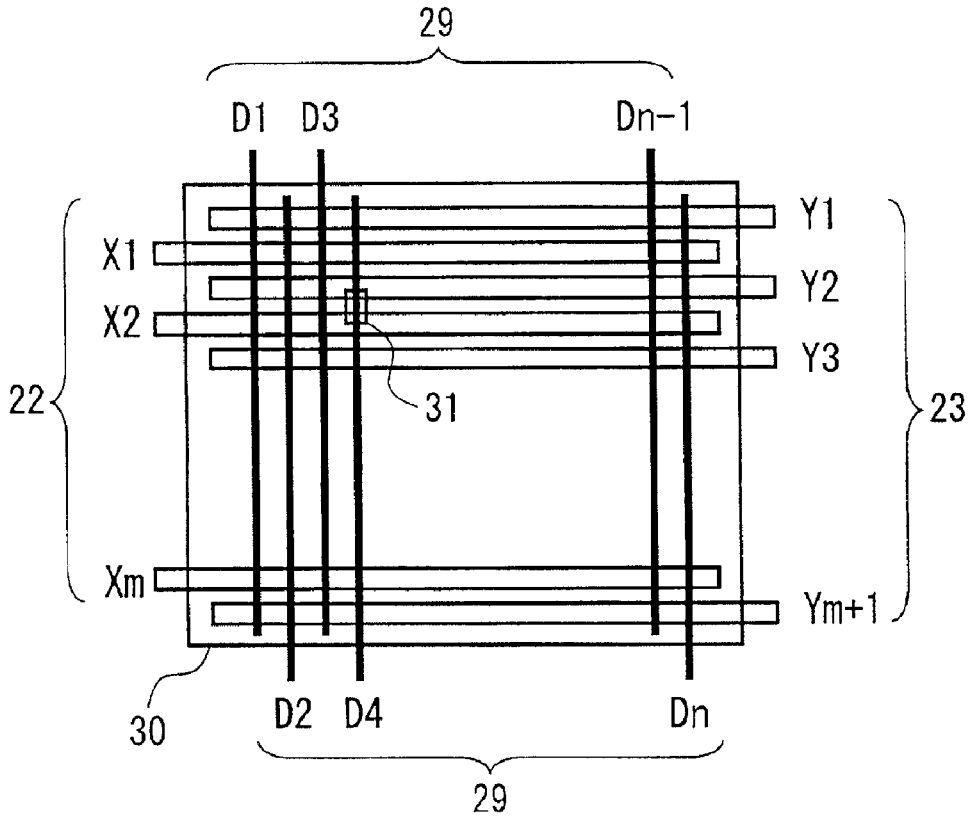
FIG. 4(PRIOR ART)
FIG. 4 is a plan view of a conventional 3-electrode AC type plasma display panel.
Figure 8:
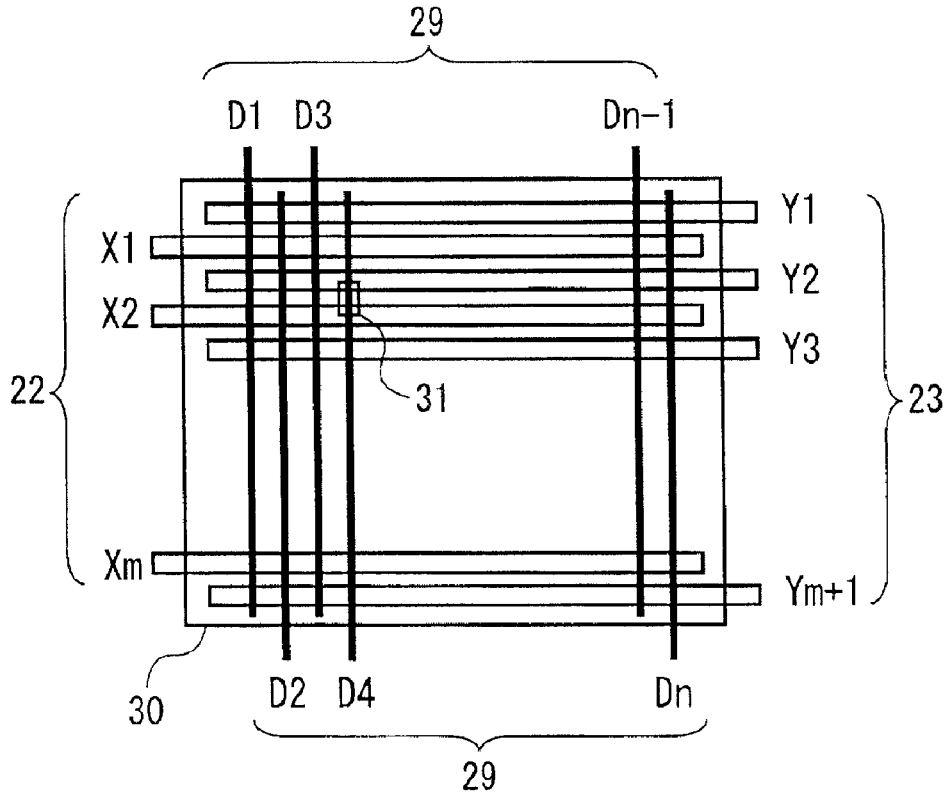
FIG. 8 is a plan view of a panel of a first embodiment of the invention.
Figure 9:
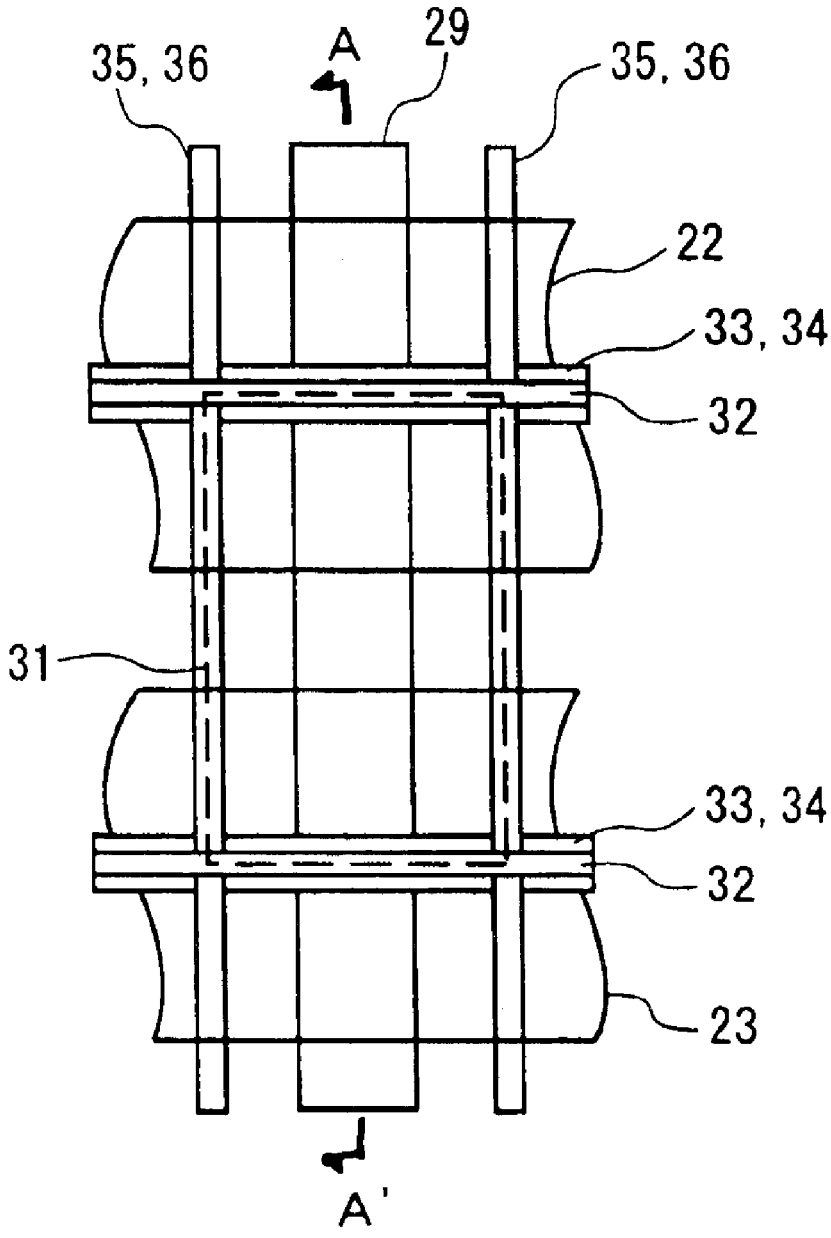
FIG. 9 is a plan view of one cell of the first embodiment of the invention.
Figure 10:
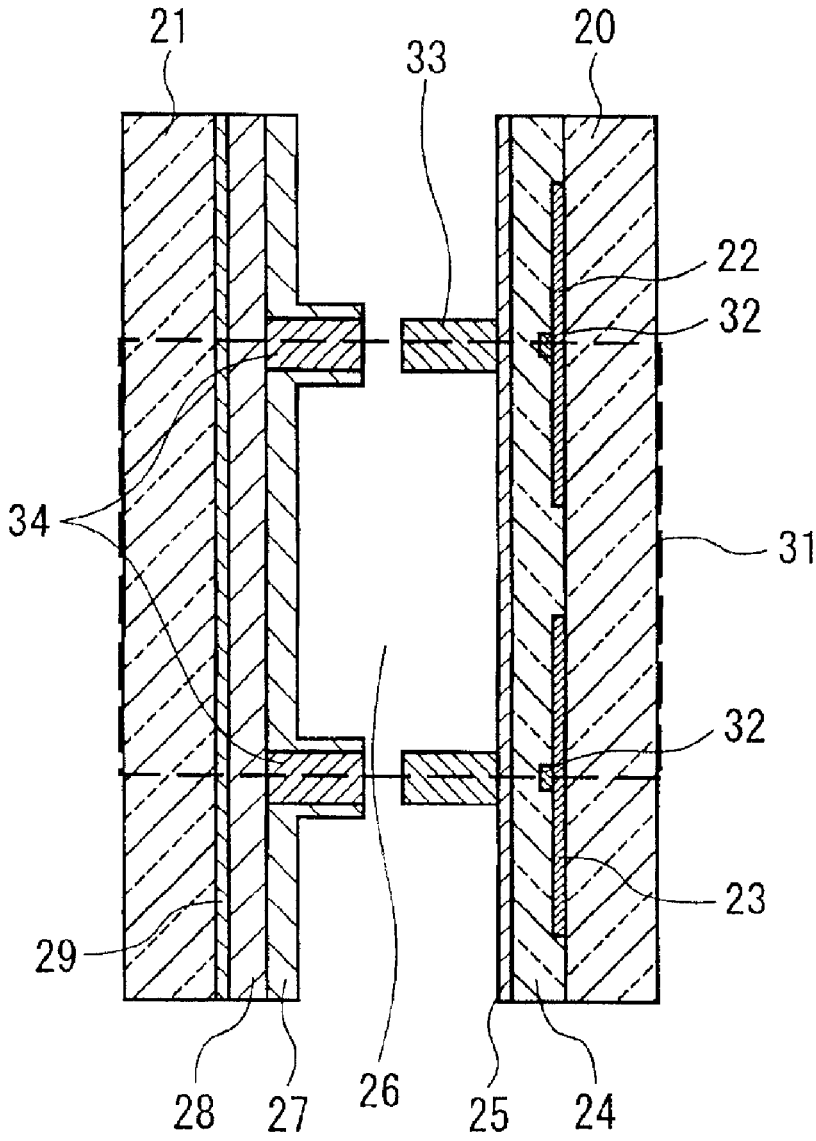
FIG. 10 is a sectional view of one cell of the first embodiment of the invention.

FIG. 8 is a plan view of a 3-electrode AC type plasma a display panel of the first embodiment of the invention. The electrode arrangement in the panel is the same as in FIG. 4. m of X electrodes 22 and m+1 of Y electrodes 23 are provided and alternately arranged at equal intervals. One cell 31 is at each intersection of the (2m−1) spaces between the X electrodes and Y electrodes and the (n) data electrodes, and a total of (2m−1)×n of pixels exist. Next, a plan view of one cell is shown in FIG. 9. A sectional view along the A–A' line of FIG. 9 is shown in FIG. 10. As two upper and lower insulating substrates 20 and 21, soda-lime glass substrates with a thickness of 2 through 5 mm are used. On the upper insulating substrate 20, transparent electrodes made from tin oxide or indium oxide with a film thickness of 100 nm through 500 nm are provided so as to be paired as X electrodes 22 and Y electrodes 23. For example, when the cell pitch is set to 0.6 mm, the tip widths of the X electrodes 22 and Y electrodes 23 are set to approximately 500 through 550 μm, and the gap between two electrodes is set to approximately 50 through 100 μm. Metal electrodes 32 of Ag or the like with a thickness of approximately 2 through 7 μm are provided on a portion of each transparent electrode to lower wiring resistances. On the metal electrodes, transparent dielectric layers 24 with a thickness of approximately 10 through 50 μm are formed by using PbO—$B_2O_3$—$SiO_2$-based low melting point glass paste with a relative dielectric constant of 10 through 25, and baked at 500 through 600° C. Thereon, protective layers 25 for protecting dielectric layers 24 are further formed to be 0.5 through 2 μm in thickness by depositing MgO. Furthermore, along the metal electrodes 32, cell partitions 33 with a width of 50 through 200 μm are provided to be about half (40 through 50 μm) in height of the cell gap (100 through 130 μm). The cell partitions 33 and vertical line partitions 35 which are at the upper insulating substrate 20 side and have the same height as that of the cell partitions 33 (width: approximately 50 through 70 μm) are simultaneously formed by means of sandblasting.

On the other hand, data electrodes 29 are formed from Ag or the like so as to be approximately 2 through 4 μm in thickness on the lower insulating substrate 21. Above them, white dielectric layers 28 are provided. The white dielectric layers 28 are formed to be approximately 5 through 40 μm in thickness by using white glass paste obtained by mixing PbO—$B_2O_3$—$SiO_2$-based low melting point glass paste with a relative dielectric constant of approximately 10 through 25 and $TiO_2$ at a ratio of 10:1, and then baked at 500 through 600° C. Above them, cell partitions 34 are formed to be approximately 40 through 50 μm in height by printing white glass paste and baking it at 500 through 600° C. Next, vertical line partitions 36 at the lower insulating substrate 21 side are formed by applying the paste and then applying sandblasting. At this time, the height of the vertical line partitions 36 is increased to be approximately 20 μm higher than the height of the cell partitions 34 so that gaps as exhaust paths are formed between the cell partitions 33 and 34 when the two insulating substrates 20 and 21 are adhered together. Finally, fluorescent materials 9 are applied to be approximately 10 through 15 μm in thickness. At this time, if the kinds of fluorescent materials are distinguished by RGB (red, green, blue) for each cell, full-color display becomes possible. $(Y,Gd)BO_3$:Eu is used for the R (red) fluorescent material, $Zn_2SiO_4$:Mn is used for the G (green) fluorescent material, and $BaMgAl_{10}O_{17}$:Eu is used for the B (blue) fluorescent material.

The two insulating substrates are adhered together and baked at 350 through 500° C., and then gases inside the cells are exhausted, and a mixed gas of He, Ne, and Xe is sealed within the cells by 200 through 600 torr as a discharge gas and sealed up, whereby the panel is completed.

Figure 11:
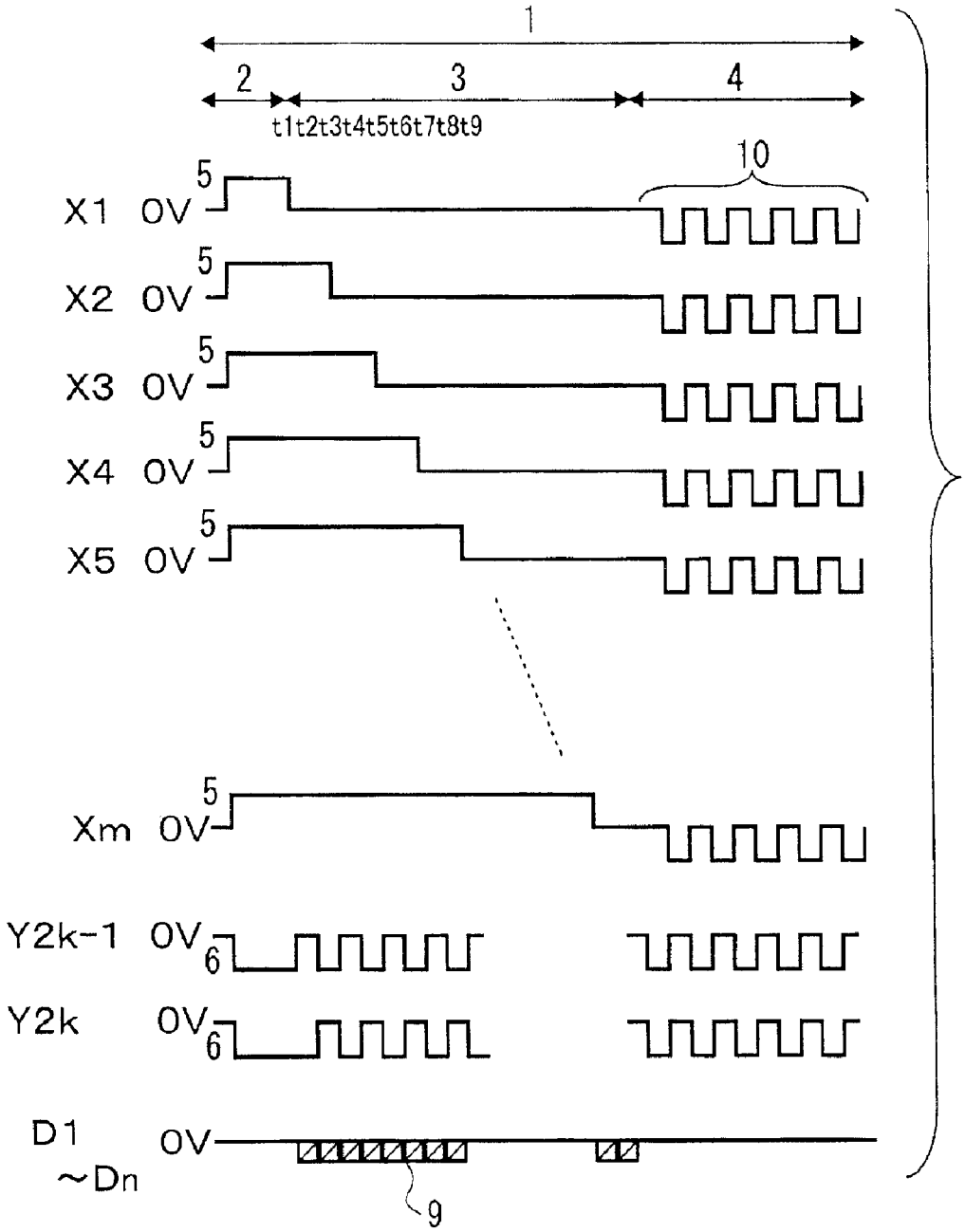
FIG. 11 is a diagram showing drive waveforms in the first embodiment of the invention.

Next, a drive method of a first embodiment of the invention is explained with reference to FIG. 11. In the preliminary discharge period 2, positive preliminary discharge pulses are applied to the X electrodes 22, and negative preliminary discharge pulses are applied to the Y electrodes 23. The voltage of the positive preliminary discharge pulse 5 is set to 160V, and the voltage of the negative preliminary discharge pulse 6 is set to −160V. The pulse width is set to 4 through 10 μsec.

Next, the period enters the scanning period 3. The voltages applied to the X electrodes are dropped to 0V in order. The "ts" (s is an integer) in FIG. 11 are all equal intervals, and t2−t1=Δt and Δt=1.5 through 3 μsec are set. On the other hand, rectangular waves shifting a half period between odd-number lines and even-number lines are applied to the Y electrodes. Preferably, the Y2k electrode must be at −180V at a timing ts (s is an odd number) before the potential of the Y2k−1 electrode drops to 0V, so that the phase of the waveform of the Y2k electrode may be made to slightly precede. The voltage values of the rectangular waves are set to 0V and −180V. Data pulses 9 corresponding to image signals are applied every Δt which are timings at which the voltages change. The data pulse voltage is set to −80V. After the potentials of all X electrodes are dropped to 0V, the period enters the sustaining period 4. Sustaining pulses 10 to be applied to the X electrodes 22 and Y electrodes 23 in the sustaining period 4 are composed by alternately applying negative voltage pulses. The voltage value is set to −160V, and the pulse width is set to 3 through 10 μsec.

Next, the operation at this time is explained with reference to the drawings showing the wall charge formation conditions of FIGS. 22A to 22D. FIGS. 22A to 22D show sectional views along A–A' line of FIG. 9, and schematically show wall charge amounts on each electrode.

Figure 22A:
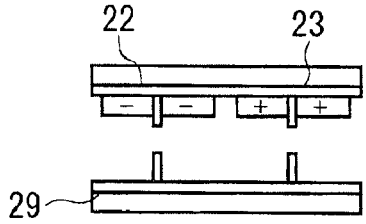
FIGS. 22A to 22D are conceptional views showing changes in wall charges in the drive of the invention.

In the preliminary discharge period 2, surface discharge occurs between the X electrode 22 and Y electrode 23, a negative wall charge is formed on the X electrode 22, and a positive wall charge is formed on the Y electrode 23. The wall charge formation condition at this time is as shown in FIG. 22A. In FIGS. 22A to 22D, wall charges are schematically shown as if they are evenly formed on each electrode, however, it is considered that in actuality wall charges are formed while having distributions.

Figure 22B:
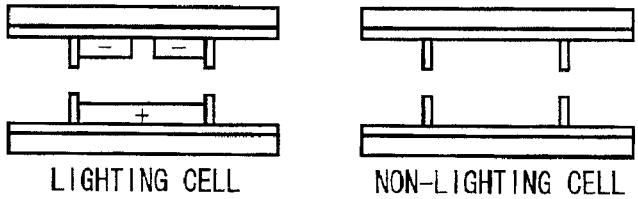

When the preliminary discharge period 2 is ended, the period enters the scanning period 3. The potential of the X1 electrode drops to 0V at the timing t1 in the scanning period 3. At the same timing, the odd-numbered line Y electrodes also drop to 0V. Therefore, due to the negative wall charge on the X1 electrode and the positive wall charge on the Y1 electrode, surface discharge occurs between the X1 electrode and Y1 electrode. At this time, the potentials of odd-numbered line Y electrodes other than the Y1 electrode also change, however, the potentials of the X electrodes adjacent to them do not change, so that surface discharge does not occur. That is, surface discharge occurs only at a portion at which potentials of both X electrode and Y electrode have dropped to 0V, surface discharge has not occurred yet in the scanning period 3, and wall charges that have been formed in the preliminary discharge period 2 still remain. At this timing t1, data pulses 9 corresponding to image signals are applied. In the present embodiment, negative data pulses are applied in the case of lighting cells. At the timing t1, the X1 electrode and Y1 electrode have the same potential, so that the same amount of wall charge is formed on them. At this time, cell partitions 33 are formed between adjacent cells at the centers of the X electrodes 22 and Y electrodes 23, so that the formation of wall charges is limited to a range sandwiched by the cell partition 33 on the X1 electrode and the cell partition 33 on the Y1 electrode, and wall charges on the X1 electrode and Y1 electrode at the opposite side of the cell partitions 33 do not change. If data pulses 9 are applied at this timing, positive wall charges are formed on the data electrodes 29, and negative wall charges are formed on the X1 electrode and Y1 electrode. On the other hand, if data pulses 9 are not applied, all potentials of the X1 electrode, Y1 electrode, and data electrodes 29 drop to 0V, so that wall charges disappear. The wall charge formation condition at this time is shown in FIG. 22B. In FIG. 22B and Figures after FIG. 22B, the condition of wall charges of only one cell is shown, and wall charges on the X electrode 22, Y electrode 23, and data electrode 29 in the adjacent cell are not shown since they change depending on display data. At the next timing t2, the potentials of even-numbered line Y electrodes drop to 0V. Since the potential of the X1 electrode has already dropped to 0 V, in response to dropping in potential of the adjacent Y2 electrode to 0V, surface discharge occurs between the X1 electrode and Y2 electrode. If data pulses 9 are applied at the same timing, as with the case of timing t1, depending on the existence of data pulses 9, the wall charge formation condition can be changed as shown in FIG. 22B. At the timing t3, the potential of the X2 electrode becomes 0V. At this time, of the adjacent Y2 electrode and Y3 electrode, only the Y3 electrode is at 0V, so that surface discharge occurs only between the X2 electrode and Y3 electrode. At this time, as with the cases of the timing t1 and the timing t2, the wall charge condition can be changed depending on the existence of the data pulses 9. Likewise, in the later electrodes, the potentials of the X electrodes 22 are successively dropped to 0V, and in a condition where the respective X electrodes are at 0V, the potentials of odd-numbered line Y electrodes and even-numbered Y electrodes are alternately dropped to 0V, whereby it can be selected which of either between the X electrodes and odd-numbered line Y electrodes or between the X electrodes and even-numbered line Y electrodes surface discharge is to be caused. Thus, the wall charge condition shown in FIG. 22B is created in all cells.

Figure 22C:
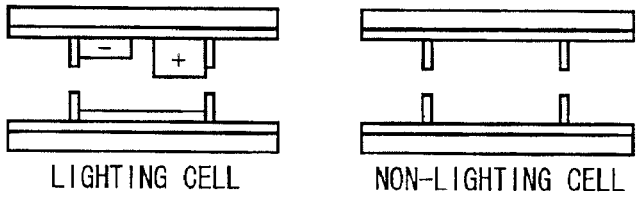
Figure 22D:
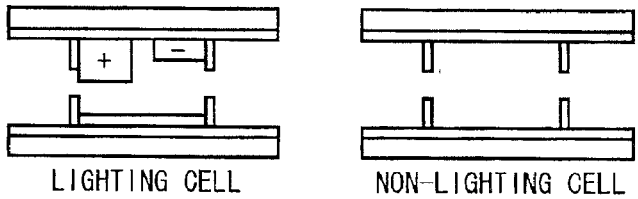

Then, the period enters the sustaining period 4. In the sustaining period 4, sustaining pulses 10 with negative polarity are alternately applied to the X electrodes 22 and Y electrodes 23. In this embodiment, the sustaining pulses 10 are applied to the Y electrodes 23 first, however, the sustaining pulses may be applied to whichever first. The voltage of this sustaining pulse 10 is set so as not to cause surface discharge by itself (−160V in this embodiment). At the end of the scanning period 3, the amounts of wall charges formed on the X electrodes and Y electrodes in both lighting and non-lighting cells are the same. Therefore, even if the wall voltage is superposed on the sustaining pulses 10, the potential difference between the surface electrodes is almost 160V, which does not reach a voltage at which discharge is started. However, in a lighting cell, since negative wall charges are formed on the Y electrodes and positive wall charges are formed on the data electrodes, opposed discharge occurs between the Y electrodes and data electrodes. Due to this opposed discharge, as shown in FIG. 22C, great positive wall charges are formed on the Y electrodes. Thereby, if the next sustaining pulses 10 are applied to the X electrodes, the negative wall charges on the X electrodes and positive wall charges on the Y electrodes are superposed on the sustaining pulses 10, surface discharge occurs between the X electrodes and Y electrodes, and as shown in FIG. 22D, the wall charge amounts on the X electrodes and on the Y electrodes become reversed to those in FIG. 22C. After this, as with the drive of the conventional plasma display, sustaining discharge occurs between surface electrodes at every inversion of the sustaining pulses 10 to carry out lighting display. On the other hand, in a case of a non-lighting cell, wall charges are not formed on the X and Y electrodes at the end of the scanning period 3, so that different from the lighting cell, opposed discharge does not occur in response to application of the first sustaining pulse. Even when subsequent sustaining pulses are applied, sustaining discharge does not occur, so that non-lighting display is carried out.

Thus, a 2m-line display screen can be progressively displayed by m of X electrode drivers and two of Y electrode drivers.

Figure 12:
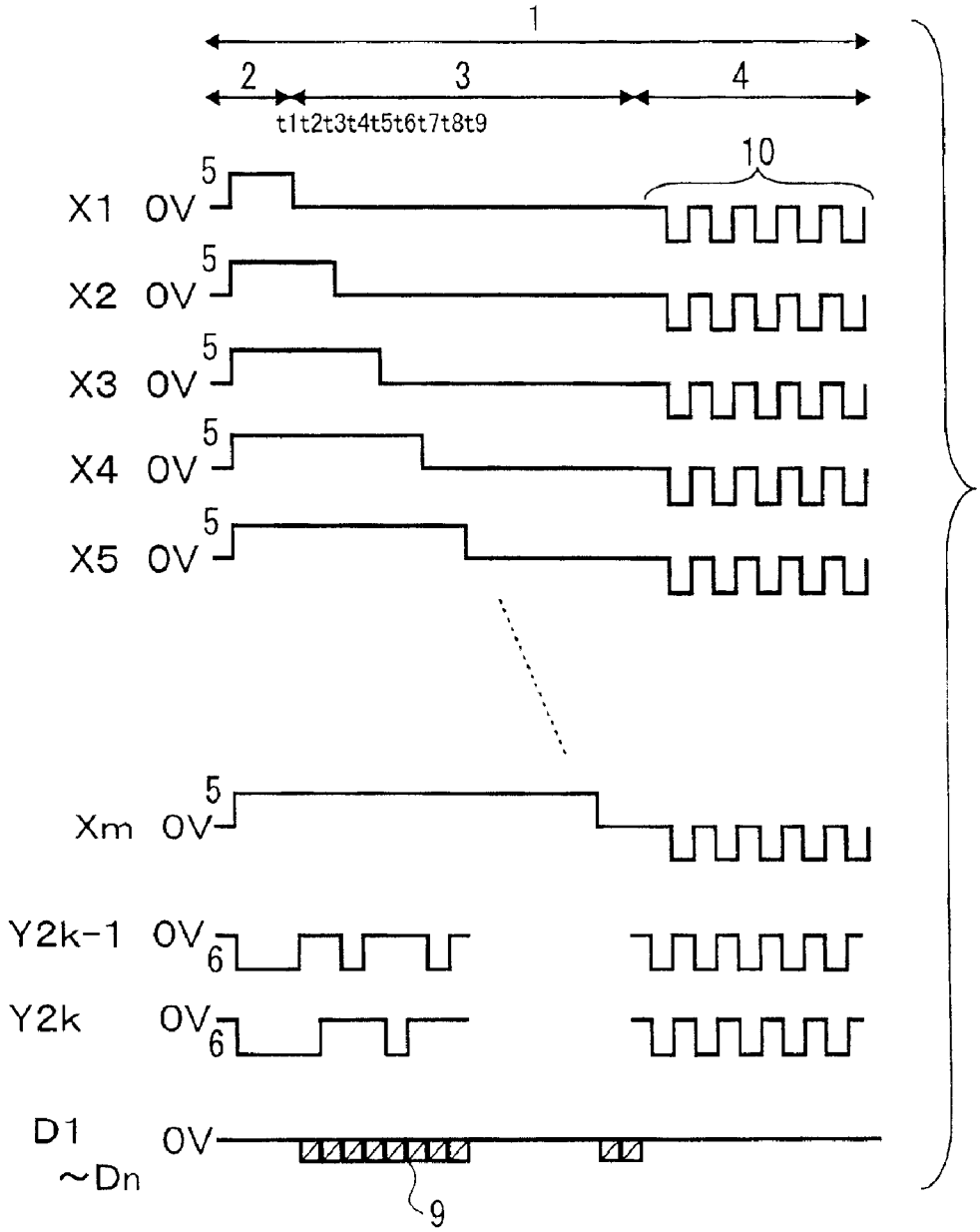
FIG. 12 is a diagram showing drive waveforms in a second embodiment of the invention.

The second embodiment of the invention is explained with reference to both of the drive waveforms of FIG. 12 and the drawings showing the wall charge formation conditions of FIGS. 22A to 22D. FIGS. 22A to 22D show sectional views along the A–A' line of FIG. 9, and schematically shows wall charge amounts on the respective electrodes. The cell structure and panel electrode arrangement are the same as in the first embodiment. The drive waveforms of the present embodiment are the same as in the first embodiment of the invention except for the waveforms in the scanning period 3 of the Y electrodes 23. In the preliminary discharge period 2, as in the first embodiment of the invention, wall charge arrangement as shown in FIG. 22A is employed. Next, the period enters the scanning period 3. The basic wall charge writing method based on display image data is the same as in the first embodiment of the invention. Surface discharge occurs only at a portion at which the potentials of both X and Y electrodes are 0V, surface discharge has not occurred yet in the scanning period 3, and wall charges that have been formed in the preliminary discharge period 2 remain. In timing with the occurrence of surface discharge, data pulses 9 corresponding to display data are applied, whereby lighting and non-lighting wall charge conditions as shown in FIG. 22B can be distinctively formed.

In the first embodiment of the invention, for all X electrodes, writing by means of surface discharge between adjacent odd-numbered line Y electrodes and X electrodes precedes, and thereafter, writing by means of surface discharge between even-numbered line Y electrodes and X electrodes is carried out. On the other hand, in this embodiment, with respect to odd-numbered line X electrodes, writing is carried out to odd-numbered line Y electrodes and even-numbered line Y electrodes in this order, and with respect to even-numbered line X electrodes, writing is carried out to even-numbered line Y electrodes and odd-numbered Y electrodes in this order. Explanation is given according to time scale. At the timing t1, the potential of the X1 electrode drops to 0V, and at the same timing, the odd-numbered line Y electrodes also drop to 0V, so that due to the negative wall charge on the X1 electrode and the positive wall charge on the Y1 electrode, surface discharge occurs between the X1 electrode and Y1 electrode, and writing is carried out. At this time, odd-numbered line Y electrodes other than the Y1 electrode also change their potentials, however, since the potentials of the adjacent X electrodes do not change, surface discharge does not occur. Next, at the timing t2, the even-numbered line Y electrodes drop to 0V, so that surface discharge occurs between the X1 electrode and Y2 electrode, and between these electrodes, wall charges for writing are formed. Therefore, with respect to the X1 (odd-numbered line) electrode, writing is carried out between the electrode and the Y1 (odd-numbered line) electrode first, and then, writing is carried out between the electrode and the Y2 (even-numbered line) electrode. At the next timing t3, the potential of the X2 electrode drops to 0V. At this time, the odd-numbered line Y electrodes change their potentials from 0V to −160V, however, at the point at which the potential of the X2 electrode becomes 0V, the potentials of the odd-numbered line Y electrodes must be −160V. Therefore, it is desirable that the phases of Y2k−1 pulses slightly precede. Between the X2 and the Y electrodes adjacent to the X2, surface discharge occurs between the X2 and the Y2 electrodes since the Y2 electrode is at 0V, however, surface discharge does not occur between the X2 and Y3 electrodes since the Y3 electrode is at −160V. Subsequently, at the timing t4, since the odd-numbered line Y electrodes reach 0V, surface discharge for writing occurs between the X2 and Y3 electrodes. Thus, with respect to the X2 (even-number line) electrode, writing is carried out between the X2 and Y2 (even-numbered line) electrodes first, and then writing is carried out between the X2 and Y3 (odd-numbered line) electrodes. After the timing t5, t1 through t5 are repeated for the Y electrodes, the potential of the X electrodes successively drop to 0V, and writing discharge occurs from the upper side to the lower side in order. Thus, writing is carried out to all lines. Details of the sustaining period 4 are the same as in the first embodiment of the invention.

Thus, as in the first embodiment of the invention, a 2m-line display screen can be progressively displayed by m of X electrode drivers and two of Y electrode drivers.

Figure 13:
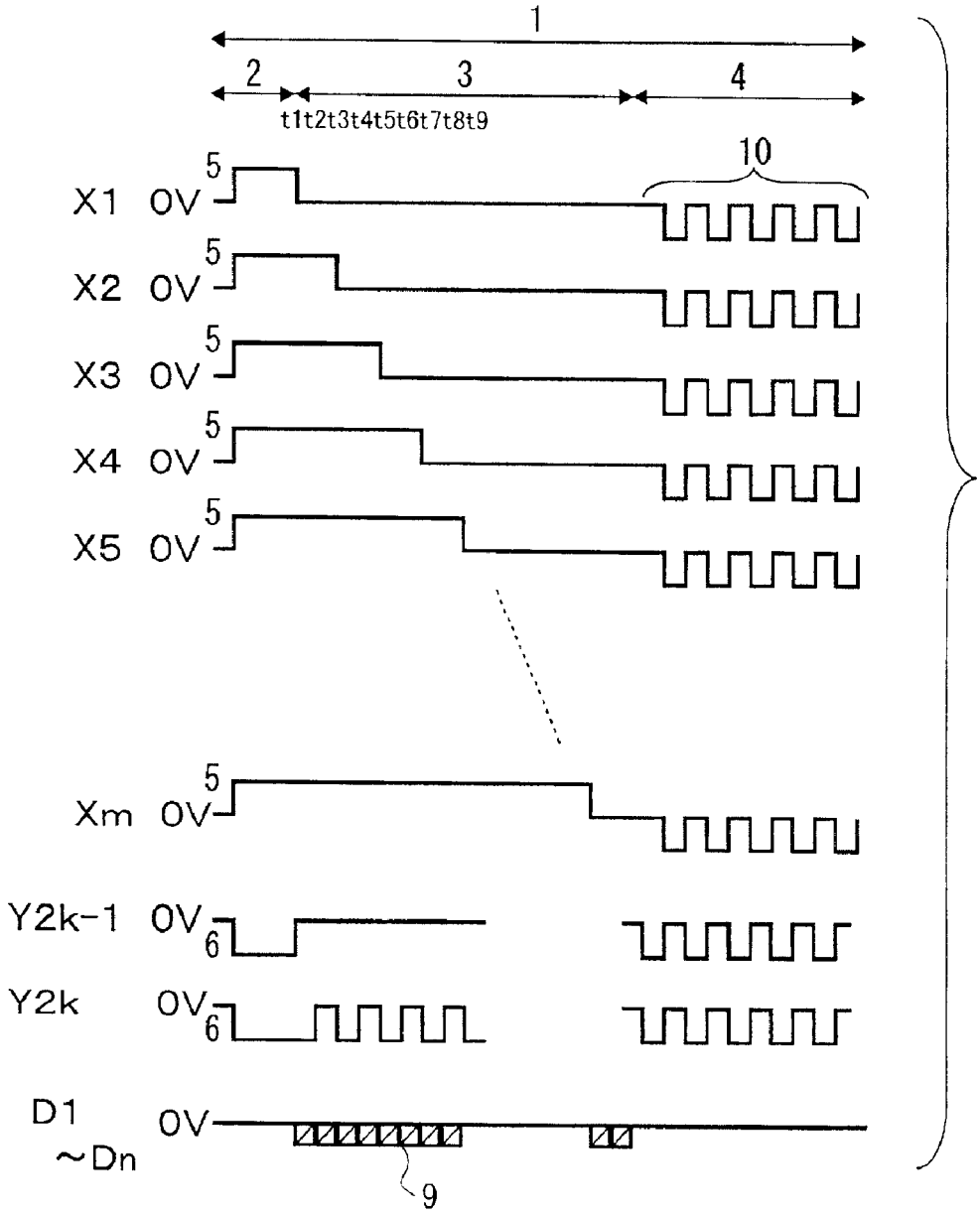
FIG. 13 is a diagram showing drive waveforms in a third embodiment of the invention.

The third embodiment of the invention is explained with reference to both drive waveforms of FIG. 13 and drawings showing wall charge formation conditions of FIGS. 22A to 22D. FIGS. 22A to 22D show sectional views along the A–A' line of FIG. 9, and schematically shows the wall charge amounts on the electrodes.

The cell structure and panel electrode arrangement are the same as in the first embodiment of the invention. The drive waveforms of the embodiment are the same as in the first embodiment of the invention except for the waveforms in the scanning period 3 of the odd-numbered line Y electrodes. In the preliminary discharge period 2, as in the first embodiment of the invention, wall charge arrangement as shown in FIG. 22A is taken. Next, the period enters the scanning period 3. The basic method for writing wall charges based on display image data is the same as in the first embodiment of the invention. Surface discharge occurs only at a point at which the potentials of both X electrode and Y electrode are 0V, surface discharge has not occurred yet in the scanning period 3, and wall charges that have been formed in the preliminary discharge period 2 remain. In exact timing with the occurrence of surface discharge, data pulses 9 corresponding to the display data are applied, whereby lighting and non-lighting wall charge conditions can be distinctively created as shown in FIG. 22B.

The order for causing surface discharge for writing is the same as in the first embodiment. That is, in both first and third embodiments of the invention, for all X electrodes, writing by means of surface discharge between the adjacent odd-numbered line Y electrodes and X electrodes precedes, and next, writing by means of surface discharge between the even-numbered line Y electrodes and X electrodes is carried out. The timings t1 and t2 are the same as in the second embodiment of the invention, and at the timing t1, surface discharge for writing occurs between the X1 electrode and Y1 electrode, and at the timing t2, surface discharge for writing occurs between the X1 electrode and Y2 electrode. At this timing t2, surface discharge has already occurred between the X1 electrode and Y1 electrode, the same wall charge amount has been formed, so that further discharge does not occur. Therefore, the potential of the Y1, that is, the odd-numbered line Y electrodes may be either 0V or −160V between them. Therefore, in this embodiment, the potential of the odd-numbered line Y electrodes at the timing t2 is left to be at 0V. The same can also be said for the timing ts (s: even numbers) after t2, so that the potentials of the odd-numbered line Y electrodes in the scanning period 3 are fixed to 0V.

Thus, writing is carried out to all lines in the same order as in the first embodiment of the invention. Details of the sustaining period 4 are the same as in the first embodiment of the invention.

Thus, as in the first embodiment of the invention, a 2m-line display screen can be progressively displayed by m of X electrode drivers and two of Y electrode drivers.

Figure 14:
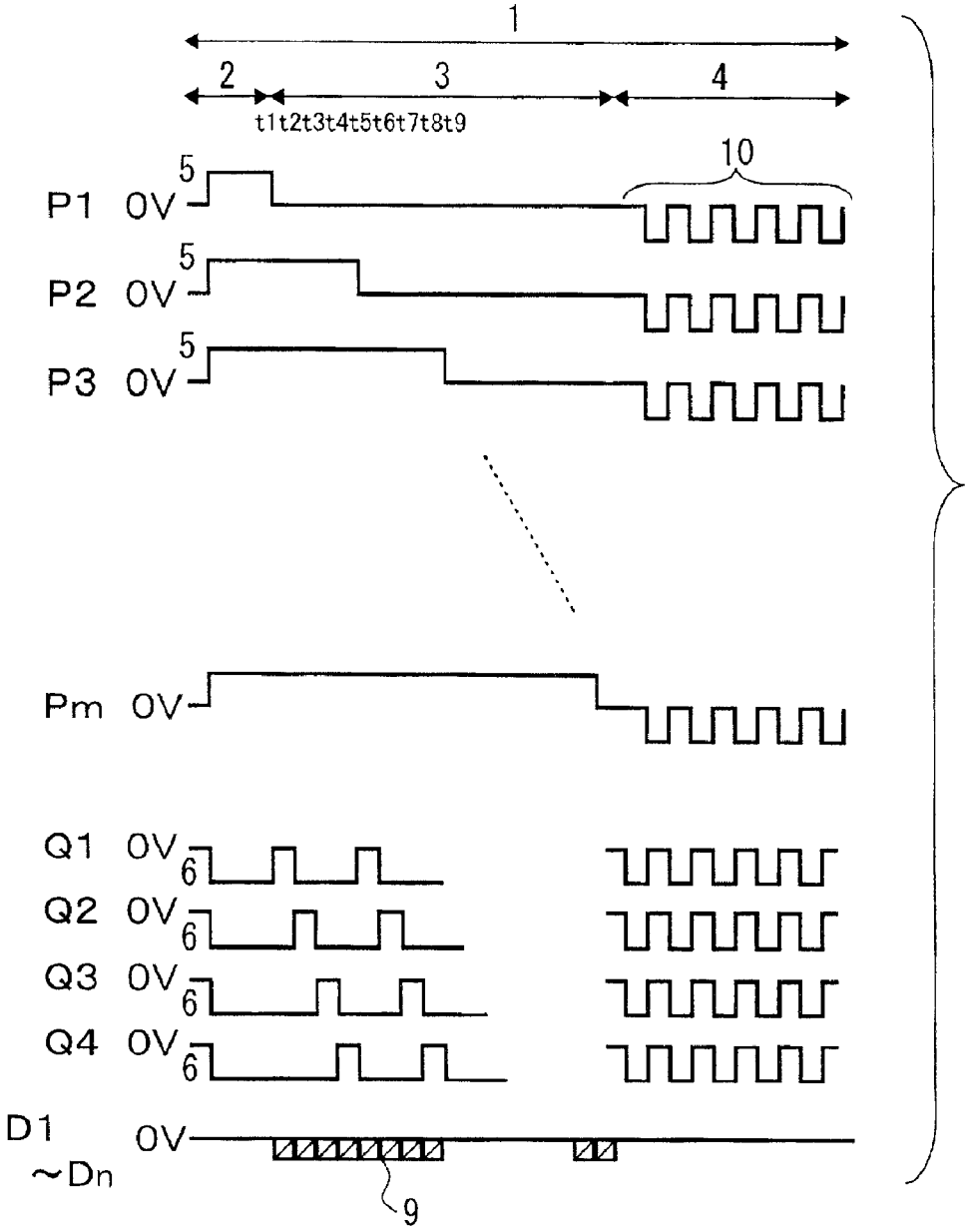
FIG. 14 is a diagram showing drive waveforms in a fourth embodiment of the invention.
Figure 15:
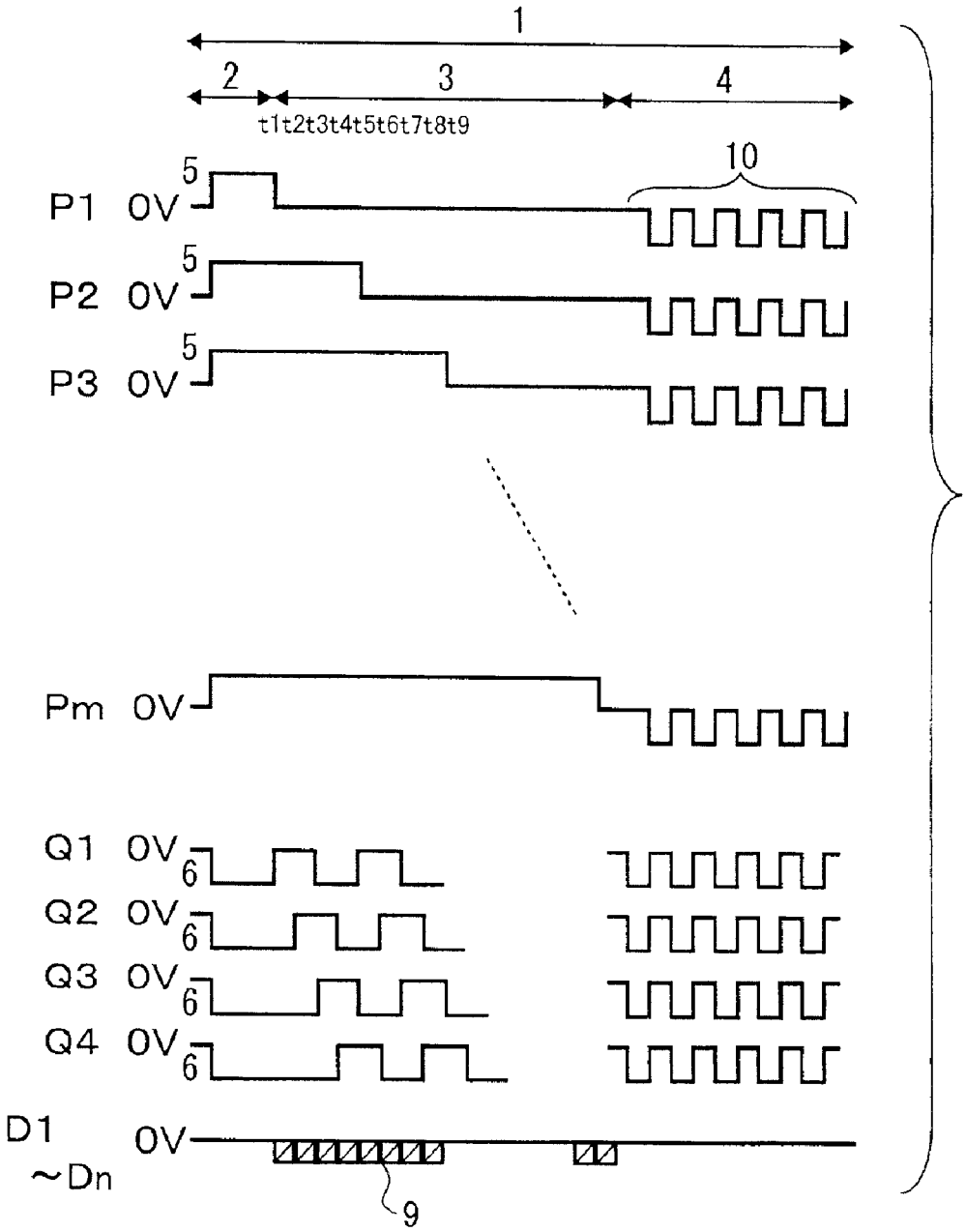
FIG. 15 is a diagram showing drive waveforms in a fifth embodiment of the invention.
Figure 17:
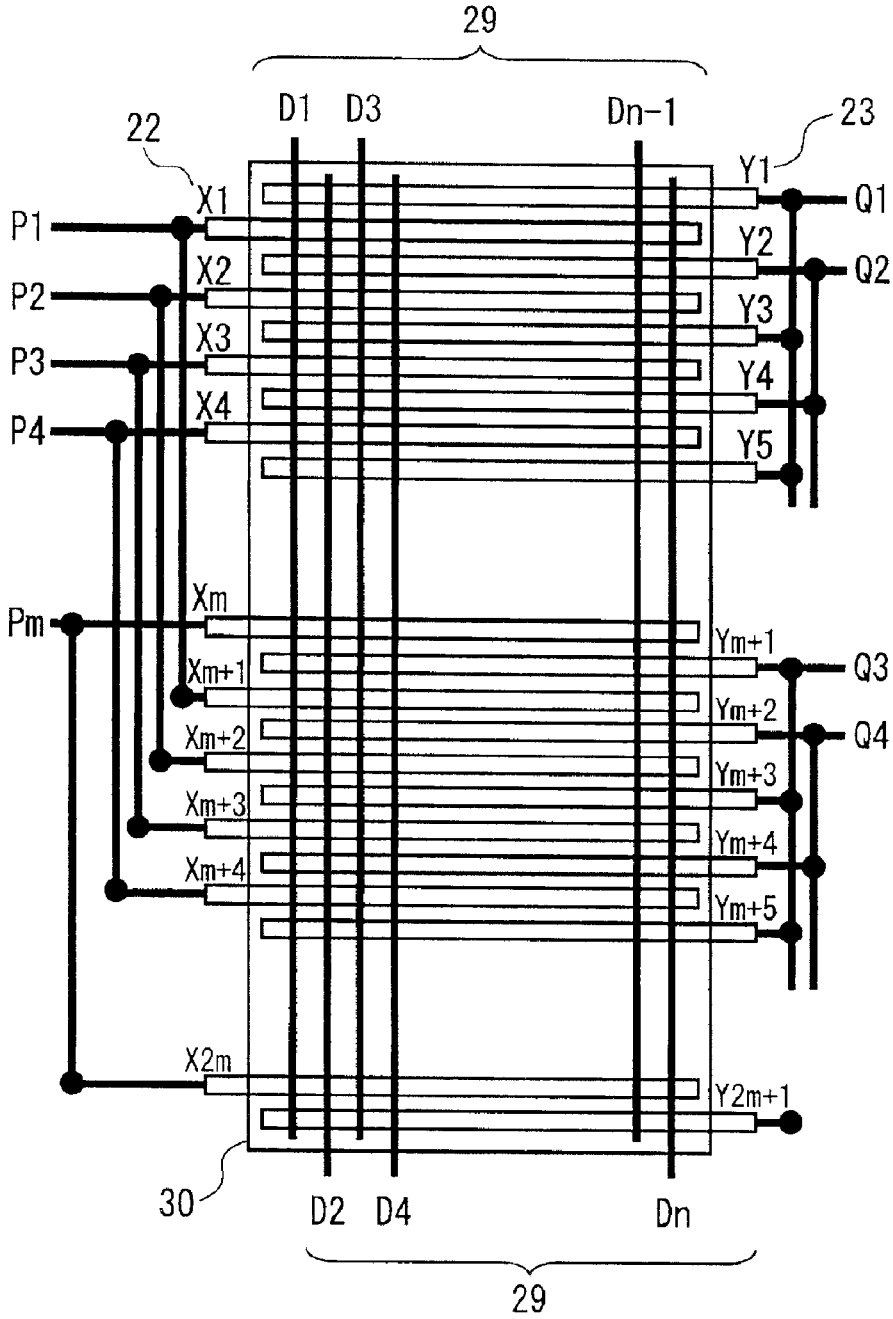
FIG. 17 is a panel electrode writing plan view in the fourth and fifth embodiments of the invention.

The fourth embodiment of the invention is explained with reference to all of the drive waveforms of FIG. 14, panel plan view of FIG. 17, wall charge formation conditions of FIGS. 22A to 22D. FIGS. 22A to 22D show sectional views along the A–A' line of FIG. 9, and schematically shows wall charge amounts on the electrodes.

The cell structure is the same as in the first embodiment of the invention. As for arrangement of electrodes, as in the first embodiment of the invention, X electrodes 22 and Y electrodes 23 are alternately disposed at equal intervals. In this embodiment, the screen is divided into two, that is, an upper screen from the Y1 to Xm electrodes, and a lower screen from the Ym+1 to Y2m+1 electrodes, and these screens are driven, respectively, in the same manner as in the first embodiment of the invention. That is, as for the respective upper and lower screens, drive waveforms that are all independent are applied to the X electrodes 22, and drive waveforms which are different between the odd-numbered line Y electrodes and even-numbered line Y electrodes are applied to the Y electrodes 23. The X electrodes on the same-numbered lines of the upper and lower screens are made to share and are driven by the same X electrode driver. That is, as shown in FIG. 17, the electrodes are made to share a driver in order from the upper side so that the X1 electrode and Xm+1 electrodes are driven by a P1 driver, and the X2 electrode and Xm+2 electrodes are driven by a P2 driver, and driving is carried out with a total of m drivers. On the other hand, as for the Y electrodes, the upper screen and the lower screen are independent from each other, and in the upper screen, odd-numbered line Y electrodes are driven by a Q1 driver, even-numbered line Y electrodes are driven by a Q2 driver, and in the lower screen, odd-numbered line Y electrodes are driven by a Q3 driver, and even-numbered line Y electrodes are driven by a Q4 driver.

Next, the operation is explained. The preliminary discharge period 2 and sustaining period 4 are the same as in the first embodiment of the invention. In the preliminary discharge period 2, wall charges as shown in FIG. 22A are formed. Next, the period enters the scanning period 3. The basic method for writing wall charges based on display image data is the same as in the first embodiment of the invention. Surface discharge occurs only at a portion at which the potentials of both X electrode and Y electrode are 0V, surface discharge has not occurred yet in the scanning period 3, and wall charges that have been formed in the preliminary discharge period 2 remain. In timing with the occurrence of surface discharge, data pulses 9 corresponding to display data are applied, whereby lighting and non-lighting wall charge conditions can be distinctively formed as shown in FIG. 22B. At the timing t1, the potential of the P1 driver turns to 0V, and the potentials of the X1 electrode and Xm+1 electrodes turn to 0V. The Y electrodes adjacent to these X electrodes are Y1, Y2, Ym+1, and Ym+2 electrodes, and only the Q1 driver is at 0V, so that only the Y1 electrode turns to 0V. Therefore, surface discharge for writing occurs between the X1 electrode and Y1 electrode. When surface discharge occurs, the same wall charge is formed on the X electrode and Y electrode at which surface discharge has occurred, and thereafter, the X electrode is maintained to be at 0V, and on the other hand, surface discharge occurs on the Y electrode at neither 0V nor −160V. Therefore, in this embodiment, after Δt immediately after discharge occurs, the potentials of the Y electrodes are returned to −160V, however, at this point, discharge does not occur and the wall charge maintains the condition that has been created when writing. Next, at the timings t2, t3, and t4, Q2, Q3, and Q4 turn to 0V in order, and surface discharge for writing occurs between the X1 and Y2 electrodes at the timing t2, surface discharge for writing occurs between the Xm+1 and Ym+1 electrodes at the timing t3, and surface discharge for writing occurs between the Xm+1 and Ym+2 electrodes at the timing t4. At the next timing t5, the potential of the P2 driver turns to 0V. Thereby, the potentials of the X2 and Xm+2 electrodes turn to 0V. At this time, as in the case where the potential of the P1 driver turns to 0V, the potentials of the Q1 through Q4 drivers are turned to 0V in order, whereby surface discharge for writing is caused between X2, Xm+2, and the adjacent four Y electrodes in order. Thus, writing is carried out to all lines. Details of the sustaining period 4 are the same as in the first embodiment.

Thus, a 4m-line screen can be progressively displayed by m of X electrode drivers and 4 of Y electrode drivers. Although the screen is divided into two upper and lower screens, the screen may be divided into more screens. If the screen is divided into r screens, 2r of Y electrode drivers become necessary. Therefore, a 2mr-line screen can be displayed by m of X electrode drivers and 2r of Y electrode drivers. For example, on the assumption that the numbers of X electrode drivers and Y electrode drivers are set to 32, respectively, m=32 and r=16, so that a 1024-line screen can be displayed. Thus, the number of display lines can be determined by multiplying the number of X electrode drivers by the number of Y electrode drivers. Therefore, to minimize the total number of X electrode drivers and Y electrode drivers, the number of X electrode drivers and the number of Y electrode drivers are made equal to each other.

Figure 5:
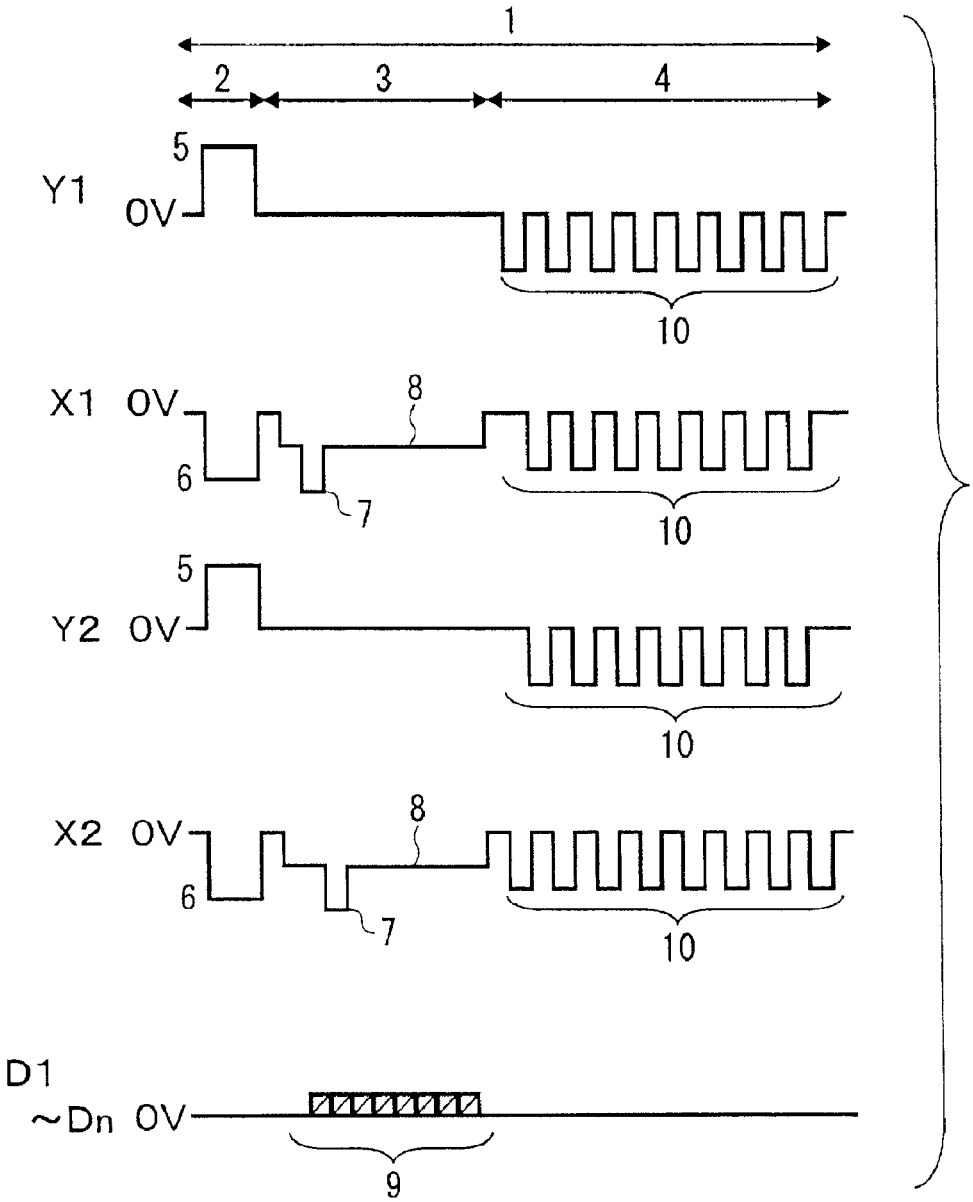
FIG. 5(PRIOR ART)
FIG. 5 is a diagram showing drive waveforms of the conventional 3-electrode AC type plasma display panel.
Figure 6:
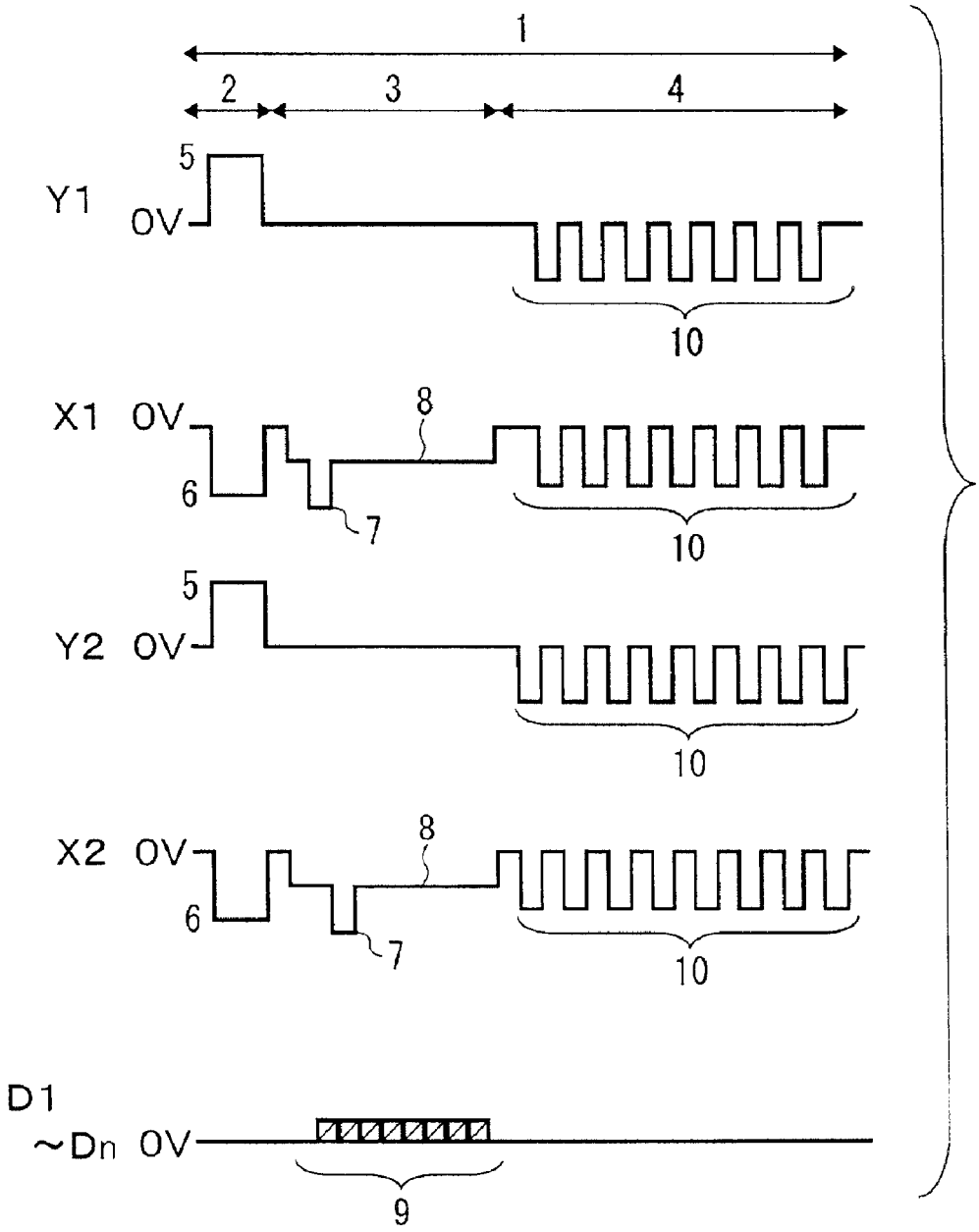
FIG. 6(PRIOR ART)
FIG. 6 is a diagram showing drive waveforms of the conventional 3-electrode AC type plasma display panel.
Figure 7:
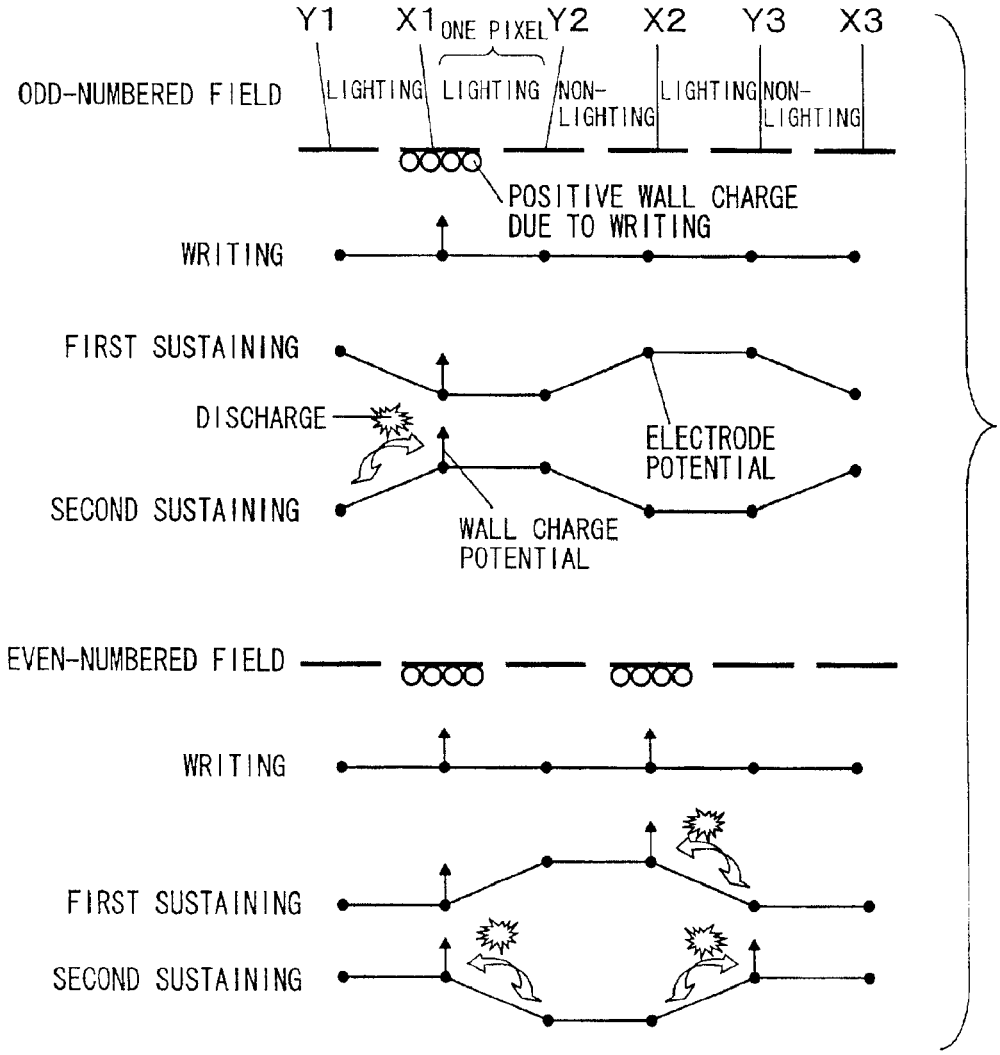
FIG. 7 (PRIOR ART)
FIG. 7 is a conceptional view of wall charges and discharge in the writing and sustaining of the conventional 3-electrode AC type plasma display panel.

The fifth embodiment of the invention is explained with reference to both of the drive waveforms of FIG. 5 and the panel plan view of FIG. 17. The cell structure, electrode arrangement, and driver connection are the same as in the fourth embodiment of the invention. The drive waveforms other than the drive waveforms of the Y electrode drivers in the scanning period 3 are the same as in the fourth embodiment of the invention. After surface discharge for writing has occurred, surface discharge occurs at neither 0V nor −160V of the potentials of the Y electrodes. Therefore, in the fourth embodiment of the invention, the potentials of the Y electrodes are restored to −160V after Δt after the occurrence of surface discharge for writing. On the other hand, in this embodiment, after 2Δt, the potentials are restored to −160V. Surface discharge occurs in neither of these cases, so that formation of wall charge is the same as in the fourth embodiment of the invention.

Thus, a 2m+1-line display screen can be progressively displayed by m of X electrode drivers and 4 of Y electrode drivers. Also in this embodiment, the number of divided screens can be increased as in the fourth embodiment of the invention.

Figure 16:
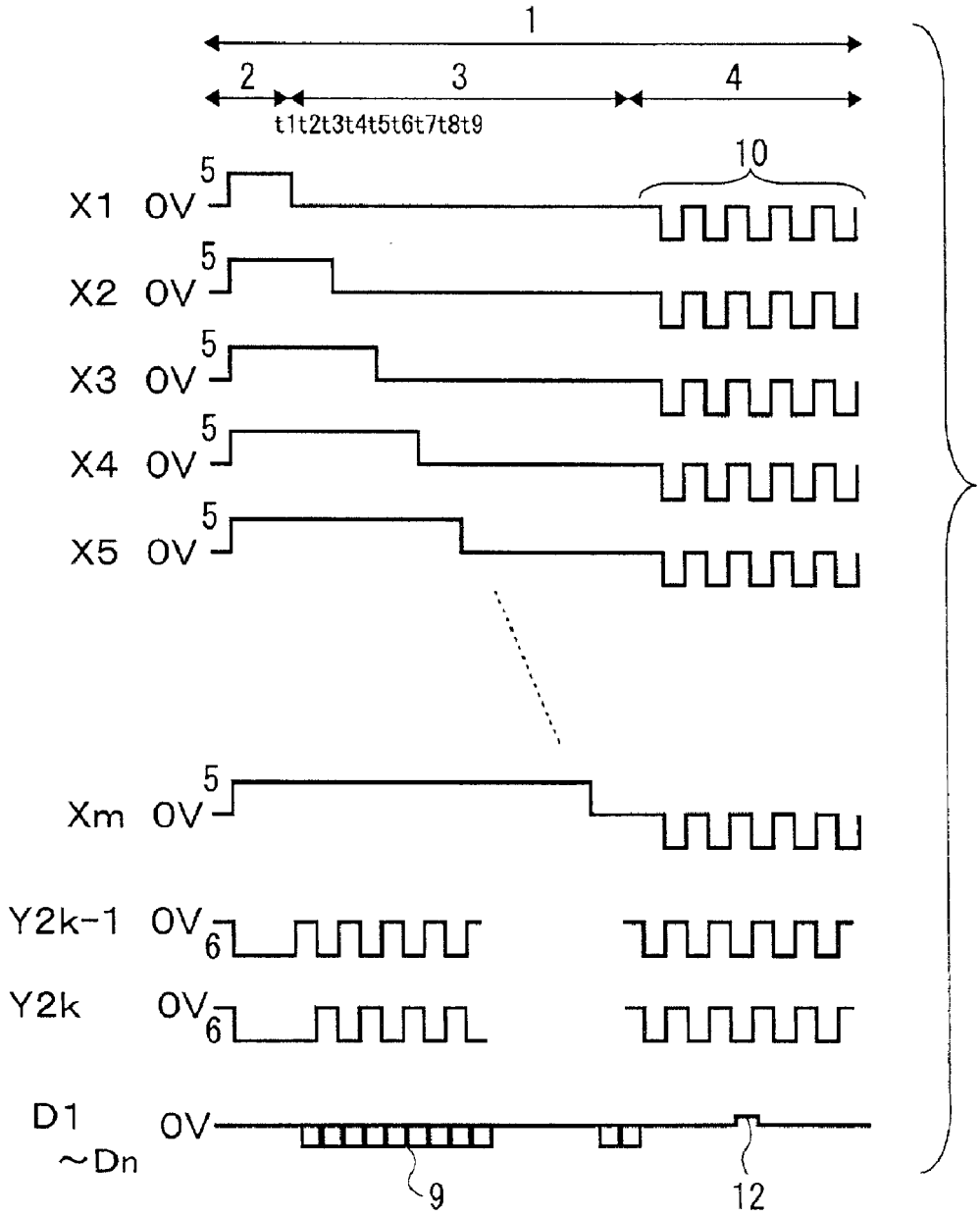
FIG. 16 is a diagram showing drive waveforms in a sixth embodiment of the invention.

The sixth embodiment of the invention is explained with reference to the drive waves of FIG. 16. The cell structure, panel electrode arrangement, and drive waves to be applied to the X electrodes and Y electrodes are the same as in the first embodiment of the invention. Therefore, the writing order is the same as in the first embodiment. In the scanning period 3, the voltage of data pulses 9 to be applied to the data electrodes is changed in three stages corresponding to display signals. In this embodiment, the voltage is changed to 0V, −40V, and −80V. In the middle of the sustaining period 4, a sustaining discharge starting control pulse 12 is applied.

Next, the operation is explained while additionally referring to FIGS. 22A to 22D. In the preliminary discharge period 2, as in the first embodiment of the invention, wall charge arrangement as shown in FIG. 22A is taken. Next, the period enters the scanning period 3. The basic method for writing wall charges based on display image data is the same as in the first embodiment of the invention. In this embodiment, the data pulse voltage is changed depending on gradations of display signals, and wall charge amounts accumulated on the X electrode and Y electrode after writing shown in FIG. 22B change in accordance with the data pulse voltage. Next, the period enters the sustaining period 4. In the scanning period 3, when the data pulse voltage is −80V, the greatest negative wall charge is accumulated on the X electrodes and Y electrodes, and is superposed on the sustaining pulses 10, whereby opposed discharge occurs. However, when the data pulse voltage is −40V or 0V, the negative wall charge amount is smaller than this voltage, so that opposed discharge does not occur even if the wall charge is superposed on the sustaining pulses 10. If opposed discharge occurs, different positive and negative great wall charges are formed on the X electrodes and Y electrodes, and thereafter, sustaining surface discharge continues. This is the same as in the first embodiment of the invention. Next, in the case where the data pulse voltage is −40V, at a timing at which the sustaining discharge starting control pulse 12 is applied in the middle of the sustaining period 4, the sustaining pulse 10, sustaining discharge starting control pulse 12, and negative wall charges on the surface electrodes are superposed and opposed discharge occurs. At this time, when the data pulse voltage is 0V, this voltage is a voltage at which opposed discharge does not occur yet. If opposed discharge has occurred, surface sustaining discharge continues thereafter. At the last, in the case where the data pulse voltage is 0V, sustaining discharge does not occur to the end. Thus, according to this embodiment, 3-gradation display is possible by one scanning (writing), so that the number of subfields for displaying gradations can be reduced. Furthermore, as in the first embodiment of the invention, a 2m-line display screen can be progressively displayed by m of X electrode drivers and 2 of Y electrode drivers.

In the present embodiment, the data pulse voltage is changed in three stages, however, by increasing the number of stages, more gradations can be displayed by one scanning, and the number of subfields can be further reduced. If the number of subfields is reduced, the number of scanning periods 3 in one field can be reduced, and accordingly, the sustaining period 4 can be lengthened. At this time, as for the sustaining discharge starting control pulse 12, pulses with different voltages are increased in accordance with the number of data pulse voltage stages. Herein, the sustaining discharge starting control pulses are applied in the sustaining period 4 in order from pulses with smaller potential differences from that of the sustaining pulse 10. This is in order for the data pulse voltages to accord with the sustaining discharge starting timings at 1:1.

As drive waveforms of the X electrodes and Y electrodes, the drive waveforms of the first embodiment of the invention are employed in this embodiment, however, the same drive is also possible even when other drive waveforms of any of the second through fifth embodiments are employed.

Figure 1:
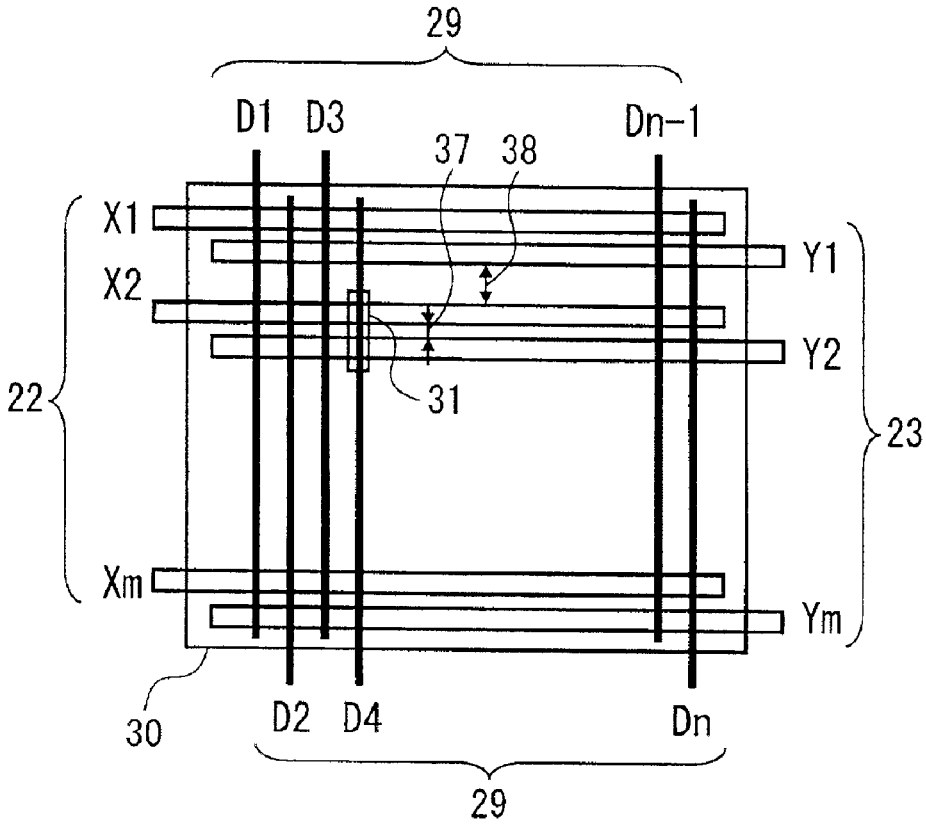
FIG. 1 (PRIOR ART)
FIG. 1 is a plan view of a conventional 3-electrode AC type plasma display panel.
Figure 2:
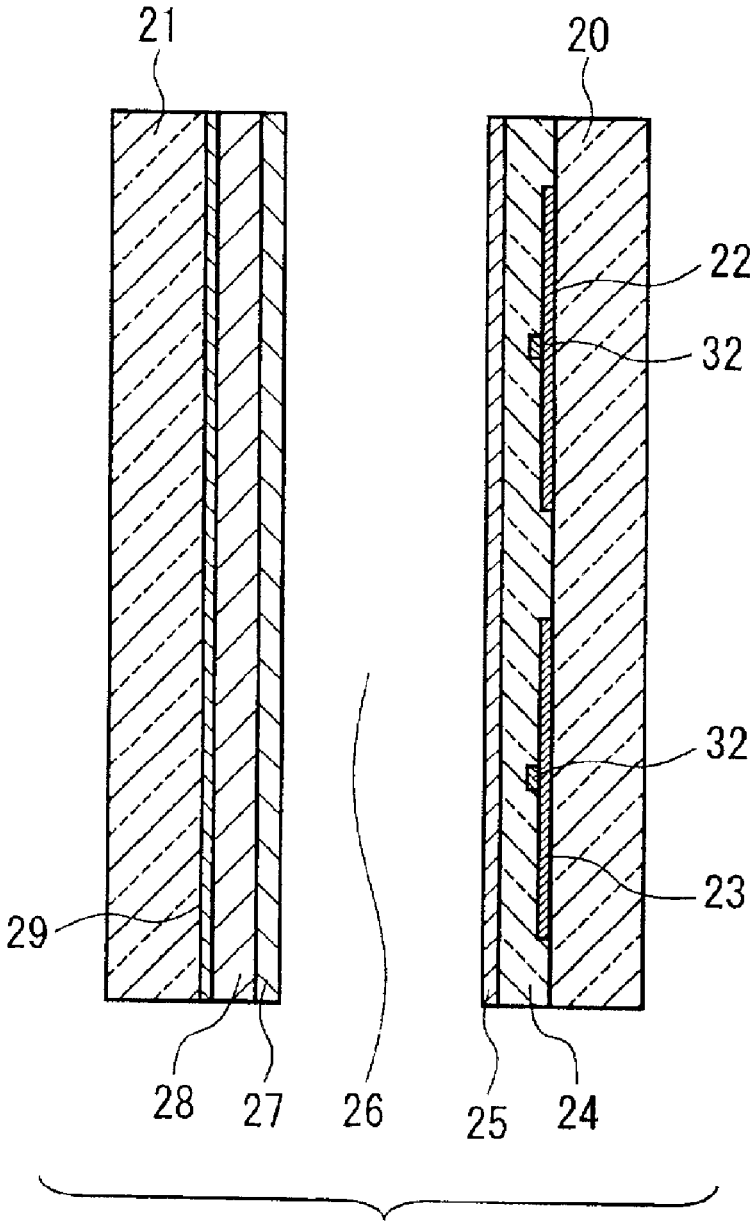
FIG. 2(PRIOR ART)
FIG. 2 is a cell sectional view of the conventional 3-electrode AC type plasma display panel.
Figure 3:
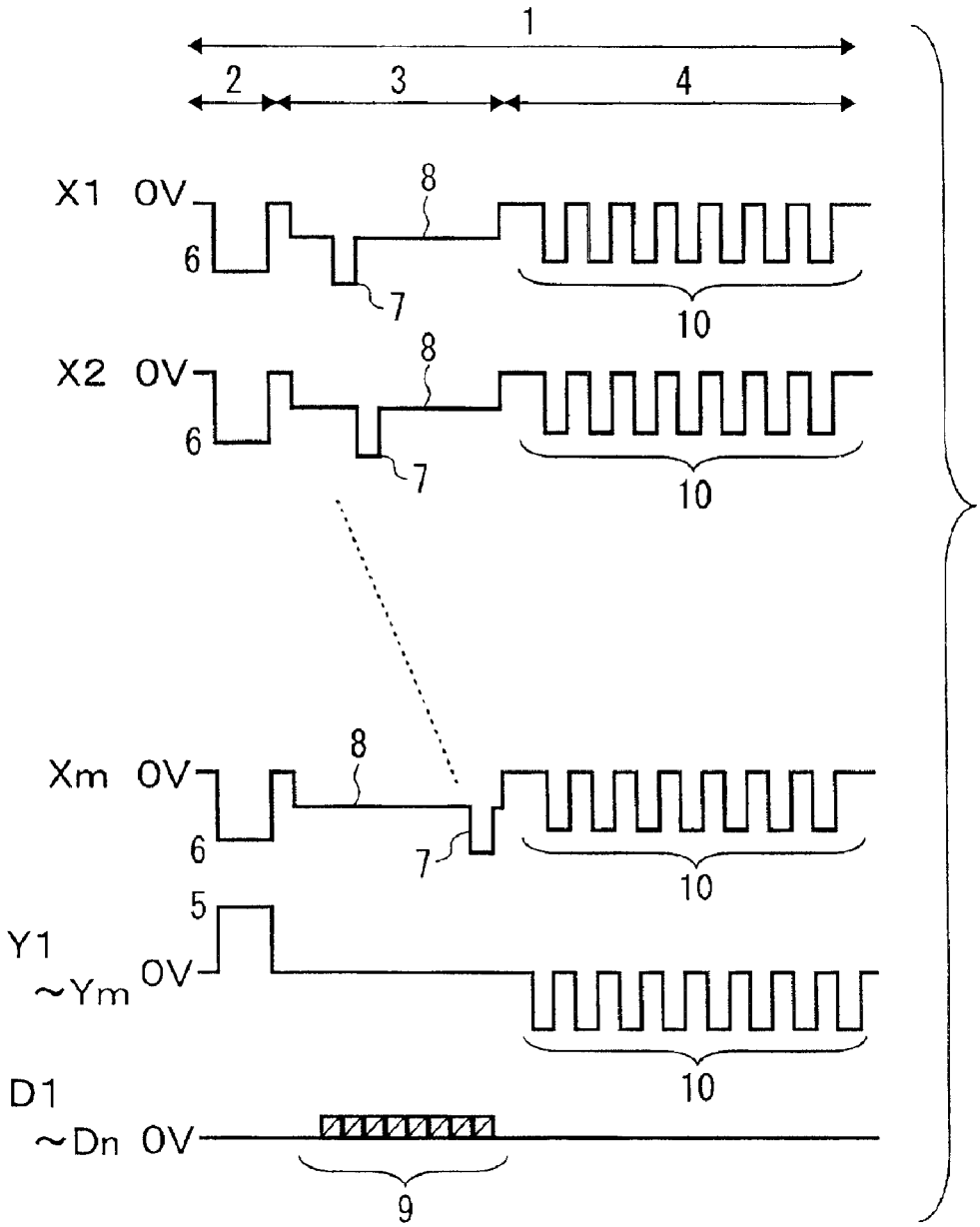
FIG. 3(PRIOR ART)
FIG. 3 is a diagram showing drive waveforms of the conventional 3-electrode AC type plasma display panel.
Figure 18:
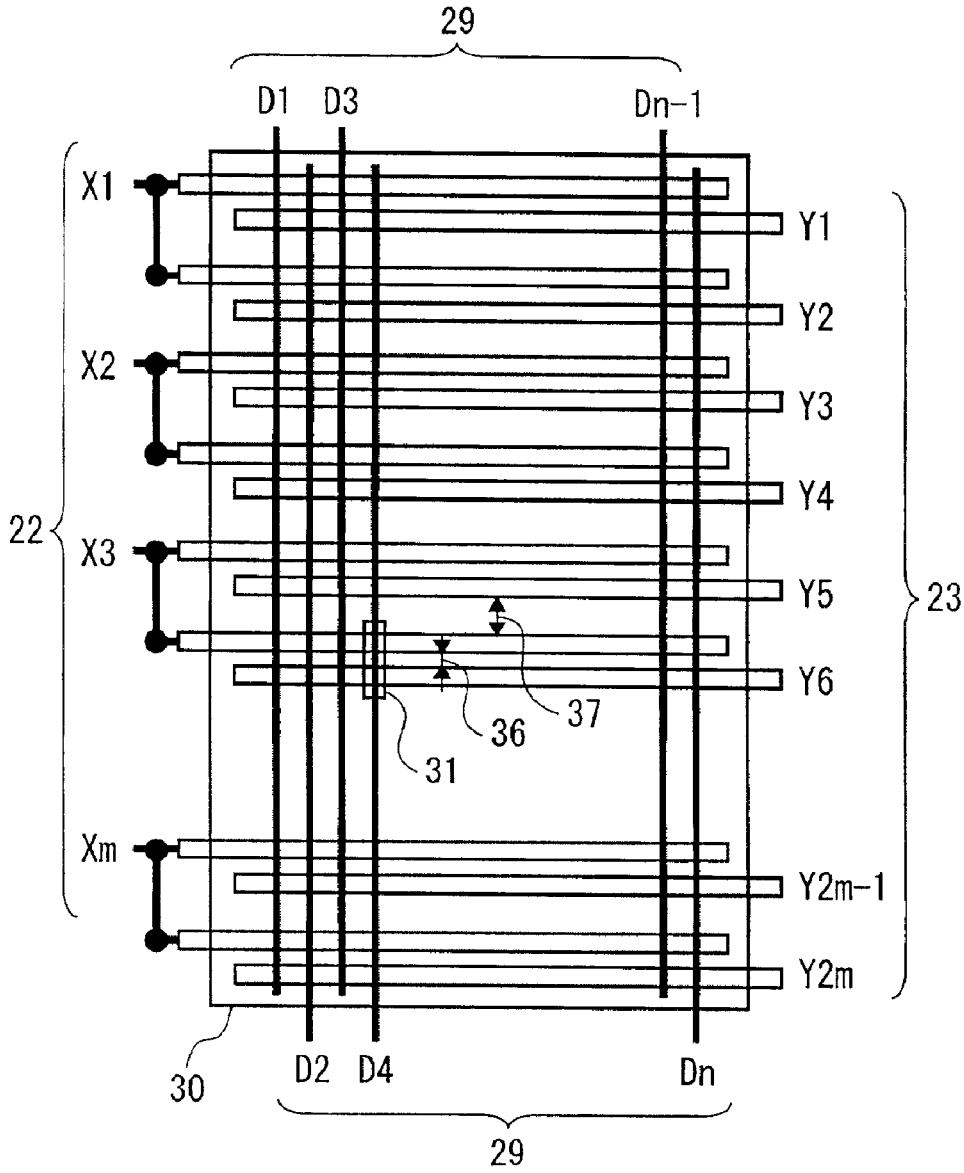
FIG. 18 is a panel electrode writing plan view in a seventh embodiment of the invention.

The seventh embodiment of the invention is explained with reference to both of the drive waveforms of FIG. 11 and the panel plan view of FIG. 18. The cell structure is the same as in the conventional example of FIG. 2. The panel electrodes are arranged so that the discharge gaps 37 and non-discharge gaps 38 alternately exist as in the conventional example of FIG. 1. Every two X electrodes are made to share a driver. The drive waveforms are the same as in the first embodiment of the invention. First, in the preliminary discharge period 2, surface discharge occurs between all discharge gaps 37, and negative wall charges and positive wall charges are formed on the X electrodes 22 and Y electrodes 23, respectively. In the case of the present embodiment, no cell partitions 33 or 34 exist on the X electrodes 22 and Y electrodes 23. Therefore, when surface discharge for writing occurs, wall charges are formed on the entire surfaces of the electrodes. The method for writing is the same as in the first embodiment of the invention, surface discharge for writing is caused between the X electrodes 22 and Y electrodes 23, and in exact timing with this, the potentials of the data electrodes 29 are changed to change the wall charge accumulation amounts, whereby writing to lighting and non-lighting cells is changed. The writing order is also the same as in the first embodiment of the invention, that is, writing is carried out for the cell between the X1 and Y1 electrodes at the timing t1, the cell between the X1 and Y2 electrodes at the timing t2, and the cell between the X2 and Y3 electrodes at the timing t3. After writing is successively carried out, the period enters the sustaining period 4. The operation herein is also the same as in the first embodiment of the invention, and in a lighting cell, opposed discharge occurs first, and then surface sustaining discharge is continued. In this embodiment, the drive waveforms of the first embodiment are used, however, the drive waveforms of the second through sixth embodiments may be used.

Thus, a 2m-line display screen can be progressively displayed by m of X electrode drivers and 2 of Y electrode drivers.

Figure 19:
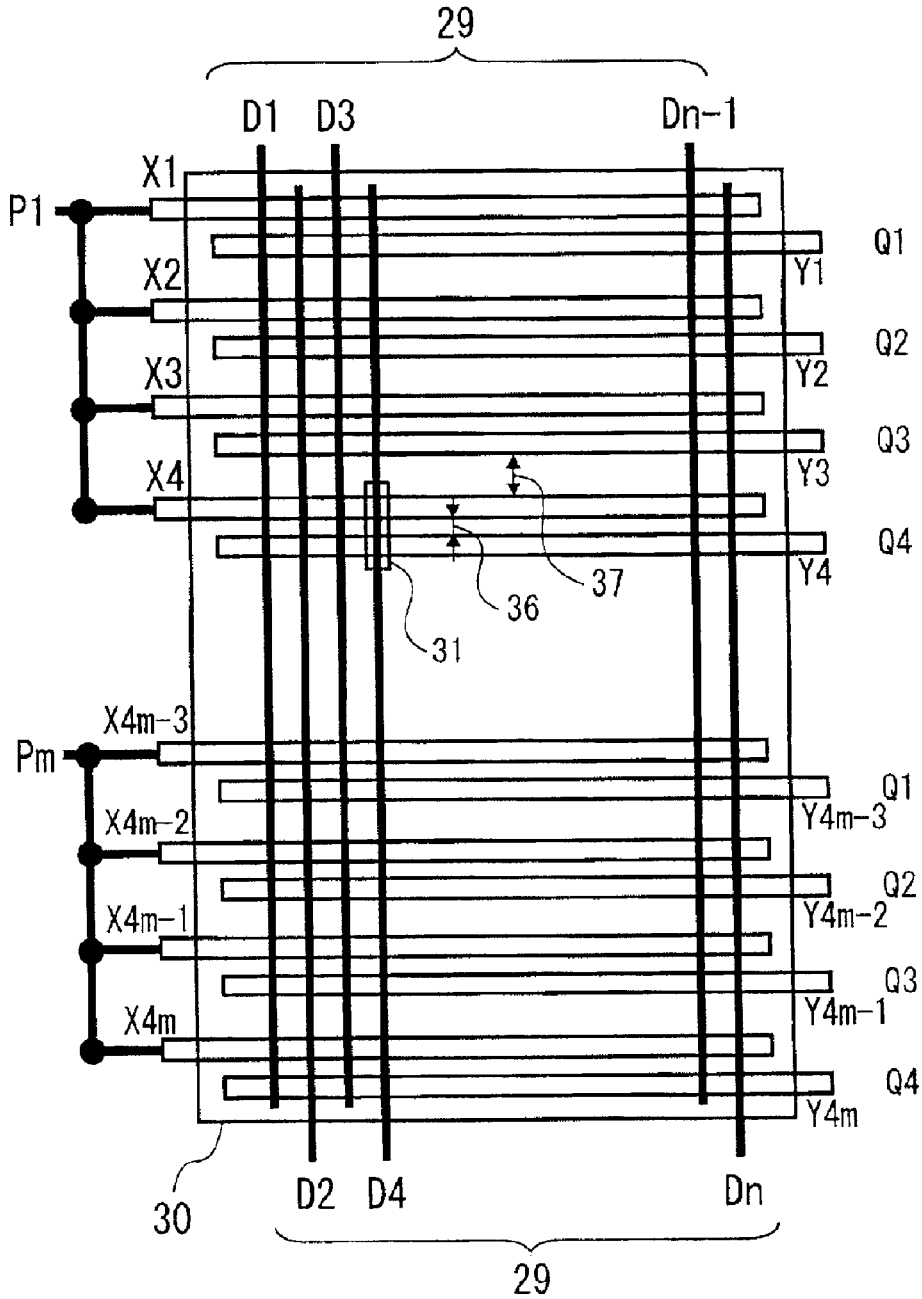
FIG. 19 is a panel electrode writing plan view in a eighth embodiment of the invention.

The eighth embodiment of the invention is explained with reference to both of the drive waveforms of FIG. 14 and the panel plan view of FIG. 19. The cell structure is the same as in the conventional example of FIG. 2. As for the panel electrode arrangement, discharge gaps 37 and non-discharge gaps 38 alternately exist as in the conventional example of FIG. 1. In this embodiment, every four X electrodes 22 are driven by the same driver P, and a total of m of P drivers are used for driving. On the other hand, as for the Y electrodes 23, Y4k−3, Y4k−2, Y4k−1, and Y4k (k is an integer) are driven by four Q drivers of Q1, Q2, Q3, and Q4. As for the operation, writing is carried out in the same order as in the fourth embodiment of the invention. In this embodiment, the drive waveforms of the fourth embodiment of the invention are used, however, the drive waveforms of the fifth embodiment may be used.

Thus, a 4m-line display screen can be progressively displayed by m of X electrode drivers and 4 of Y electrode drivers. In this embodiment, every four X electrodes 22 are driven by the same driver P, however, the number of electrodes to be driven by the same driver may be increased. When every r of X electrodes 22 are driven by the same driver P, the total number of Y electrode drivers to be required is r. Therefore, a mr-line display screen can be displayed by m of X electrode drivers and r of Y electrode drivers. For example, when the numbers of X electrode drivers and Y electrode drivers are 32, respectively, m=32 and r=32, a 1024-line screen can be displayed. Thus, the number resulted by multiplying the number of X electrode drivers by the number of Y electrode drivers is the number of lines to be displayed. Therefore, to minimize the total number of X electrode drivers and Y electrode drivers, the number of X electrode drivers and the number of Y electrode drivers may be set to be equal to each other.

Figure 20:
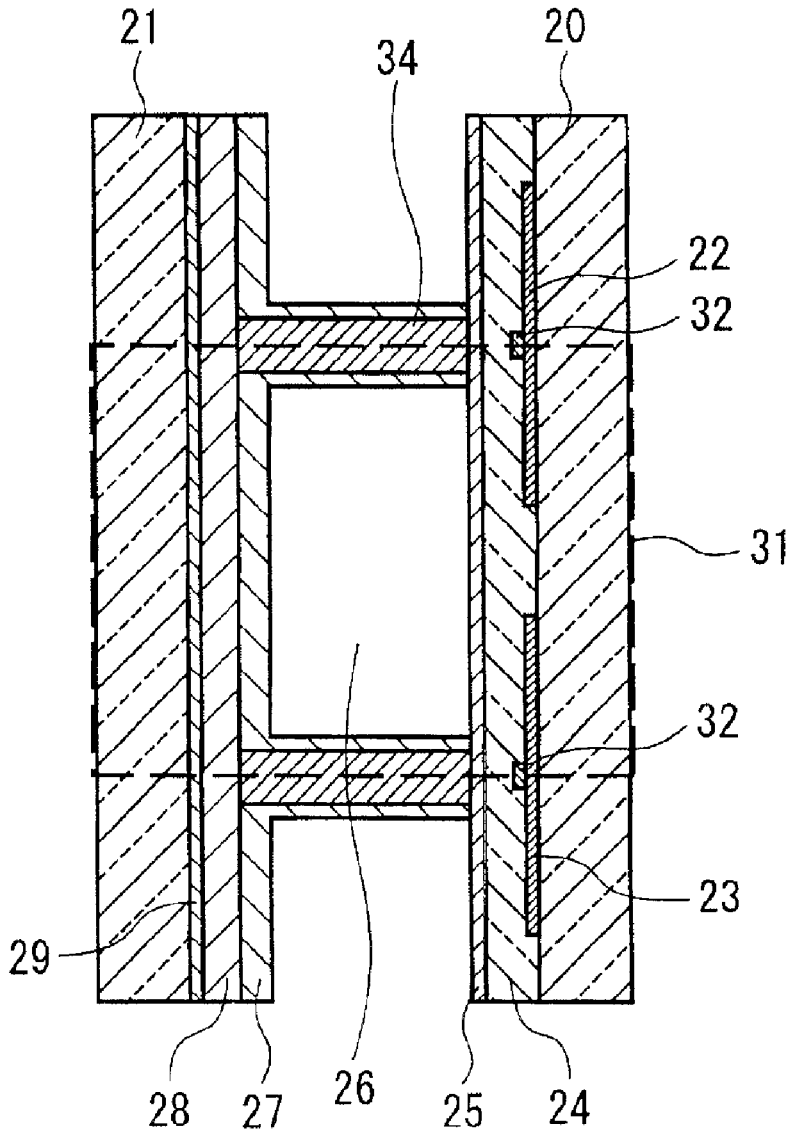
FIG. 20 is a sectional view of one cell in a ninth embodiment of the invention.

The ninth embodiment of the invention is explained with reference to both of the cell plan view of FIG. 9 and the cell sectional view of FIG. 20. The area surrounded by the dashed line in FIG. 9 shows one cell. The cell sectional view of FIG. 20 shows the section along the A–A' line of FIG. 2. The panel electrode arrangement and drive waveforms are the same as in the first embodiment of the invention. The cell structure is the same as in the first embodiment except for the cell partitions 34 formed on the lower insulating substrate 21 reaching the upper insulating substrate 20. Therefore, the drive operation is the same as in the first embodiment of the invention. In the first embodiment shown in FIG. 10, the cell partition is separated into cell partitions 33 and 34 which are separately formed on the upper insulating substrate 20 and lower insulating substrate 21. Between these two cell partitions 33 and 34, an exhaust path is provided. On the other hand, in this embodiment, the cell partitions 34 are formed only on the lower insulating substrate 21, and structured so that they are closed up for each cell. Therefore, the time for exhaustion in the panel manufacturing process takes three times, however, charged particles generated by discharge in one cell can be securely sealed in the cell, whereby erroneous lighting of the adjacent cells can be prevented. Furthermore, since the heights of the partitions at the lower insulating substrate 21 side to which fluorescent materials are applied increases, the partition area to which fluorescent materials can be applied increases, resulting in increases in luminance and efficiency.

The drive waveforms of the first embodiment of the invention are used in this embodiment, however, the drive waveforms and panel electrode arrangement of the second through sixth embodiments may be employed.

Figure 21:
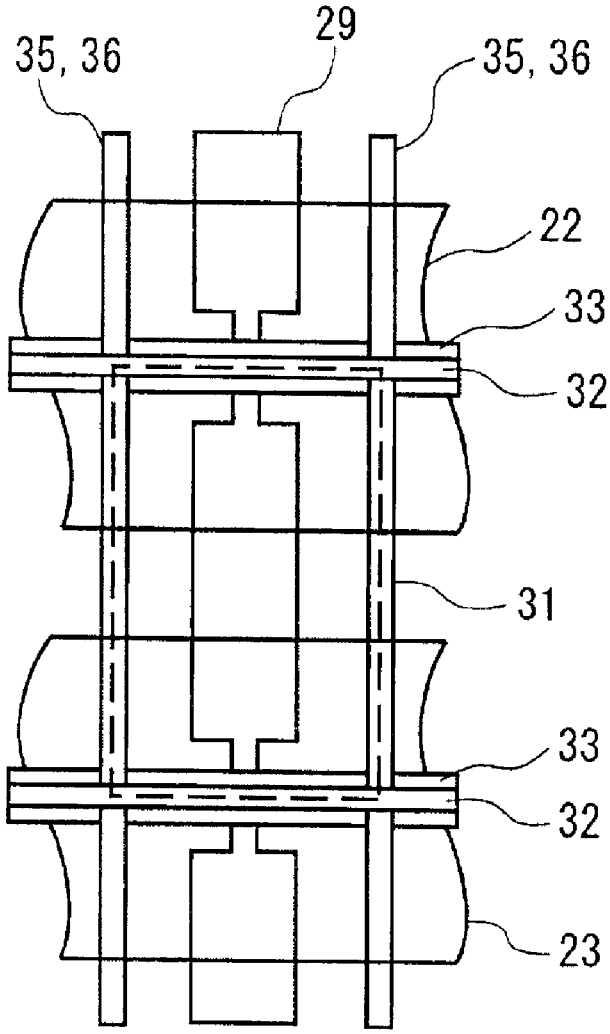
FIG. 21 is a plan view of one cell in a tenth embodiment of the invention.

The tenth embodiment of the invention is explained with reference to the cell plan view of FIG. 21 and the cell sectional view of FIG. 10. In FIG. 21, the area surrounded by the dashed line shows one cell. FIG. 10 is a cell sectional view along the A–A' line of FIG. 9. The panel electrode arrangement and drive waveforms are the same as in the first embodiment. The cell structure is the same as in the first embodiment except for the form of the data electrodes 29 formed on the lower insulating substrate 21. Therefore, the drive operation is the same as in the first embodiment of the invention. By reducing the widths of the data electrodes on the lower parts of the cell partitions 34, influences of the wall charges on adjacent cells are reduced.

In this embodiment, the drive waveforms of the first embodiment of the invention are used, however, the drive waveforms and panel electrode arrangement of the second through sixth embodiments may be used.

According to the invention described above, although only a m-line screen can be conventionally displayed by using a total of m+1 drivers including m of X electrode drivers and one Y electrode driver, display of a 2m-line screen becomes possible by using m of X electrode drivers and two of Y electrode drivers. As a monitor or TV display, m may be 480 or more, so that the same number of drivers can realize twice the display capacity. Furthermore, a plurality of X electrodes share one driver, the number of drivers can be further reduced, and 1024 lines can be displayed by using thirty-two of X electrode drivers and Y drivers.

What is claimed is:

1. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, the same amount of wall charge being written to the X electrode and Y electrode in one pixel, and lighting and non-lighting of the pixels being controlled in accordance with the wall charge amount, the X electrode and Y electrode being equalized in potential when a writing discharge occurs.

2. An AC type PDP drive method according to claim 1, wherein sustaining discharge for display is initially started by means of opposed discharge.

3. An AC type PDP drive method according to claim 2, wherein said opposed discharge is generated using the data electrodes as positive electrodes.

4. An AC type PDP drive method according to claim 2, wherein a scanning sustaining separation method is employed in that a scanning period in which the writing is carried out and the sustaining period in which sustaining discharge is caused are separated in terms of time.

5. An AC type PDP drive method according to claim 1, wherein, prior to writing, wall charges with polarities opposite to each other are formed on the X electrodes and Y electrodes, respectively, and writing discharge is caused by means of erasing and writing in which the wall charges are adjusted when applying data pulses.

6. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, wall charges being written upon making the potentials of the X electrode and Y electrode in one pixel equal to each other, and lighting and non-lighting of the pixel being controlled in accordance with the wall charge amount, a same amount of electric discharge being written to the X electrode and Y electrode.

7. An AC type PDP drive method according to claim 6, wherein sustaining discharge for display is initially started by means of opposed discharge.

8. An AC type PDP drive method according to claim 7, wherein said opposed discharge is generated using the data electrodes as positive electrodes.

9. An AC type PDP drive method according to claim 7, wherein a scanning sustaining separation method is employed in that a scanning period in which the writing is carried out and the sustaining period in which sustaining discharge is caused are separated in terms of time.

10. An AC type PDP drive method according to claim 6, wherein, prior to writing, wall charges with polarities opposite to each other are formed on the X electrodes and Y electrodes, respectively, and writing discharge is caused by means of erasing and writing in which the wall charges are adjusted when applying data pulses.

11. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, the voltage of the wall charges formed on the X electrode and Y electrode in one pixel being at a level at which surface discharge does not occur between the X electrodes and Y electrodes even if the sustaining pulse voltage is added to said voltage, the X electrode and Y electrode being equalized in potential when a writing discharge occurs.

12. An AC type PDP drive method according to claim 11, wherein sustaining discharge for display is initially started by means of opposed discharge.

13. An AC type PDP drive method according to claim 12, wherein said opposed discharge is generated using the data electrodes as positive electrodes.

14. An AC type PDP drive method according to claim 12, wherein a scanning sustaining separation method is employed in that a scanning period in which the writing is carried out and the sustaining period in which sustaining discharge is caused are separated in terms of time.

15. An AC type PDP drive method according to claim 11, wherein, prior to writing, wall charges with polarities opposite to each other are formed on the X electrodes and Y electrodes, respectively, and writing discharge is caused by means of erasing and writing in which the wall charges are adjusted when applying data pulses.

16. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, the same amount of wall charge being written into the X electrode and Y electrode in one pixel, and lighting and non-lighting of the pixel being controlled in accordance with the wall charge amount, the X electrode and Y electrode being equalized in potential when a writing discharge occurs.

17. An AC type PDP drive method according to claim 16, wherein sustaining discharge for display is initially started by means of opposed discharge.

18. An AC type PDP drive method according to claim 17, wherein said opposed discharge is generated using the data electrodes as positive electrodes.

19. An AC type PDP drive method according to claim 17, wherein a scanning sustaining separation method is employed in that a scanning period in which the writing is carried out and the sustaining period in which sustaining discharge is caused are separated in terms of time.

20. An AC type PDP drive method according to claim 16, wherein, prior to writing, wall charges with polarities opposite to each other are formed on the X electrodes and Y electrodes, respectively, and writing discharge is caused by means of erasing and writing in which the wall charges are adjusted when applying data pulses.

21. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, wall charges being written upon making the potentials of the X electrodes and Y electrodes in one pixel equal to each other, and lighting and non-lighting of the pixel being controlled in accordance with the wall charge amount, a same amount of electric discharge being written to the X electrode and Y electrode.

22. An AC type PDP drive method according to claim 21, wherein sustaining discharge for display is initially started by means of opposed discharge.

23. An AC type PDP drive method according to claim 22, wherein said opposed discharge is generated using the data electrodes as positive electrodes.

24. An AC type PDP drive method according to claim 21, wherein, prior to writing, wall charges with polarities opposite to each other are formed on the X electrodes and Y electrodes, respectively, and writing discharge is caused by means of erasing and writing in which the wall charges are adjusted when applying data pulses.

25. An AC type PDP drive method according to claim 22, wherein a scanning sustaining separation method is employed in that a scanning period in which the writing is carried out and the sustaining period in which sustaining discharge is caused are separated in terms of time.

26. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, the voltage of the wall charges formed on the X electrode and Y electrode in one pixel being at a level at which surface discharge does not occur between the X electrode and Y electrode even if the voltage of the sustaining pulse is added to said voltage, the X electrode and Y electrode being equalized in potential when a writing discharge occurs.

27. An AC type PDP drive method according to claim 26, wherein sustaining discharge for display is initially started by means of opposed discharge.

28. An AC type PDP drive method according to claim 27, wherein said opposed discharge is generated using the data electrodes as positive electrodes.

29. An AC type PDP drive method according to claim 27, wherein a scanning sustaining separation method is employed in that a scanning period in which the writing is carried out and the sustaining period in which sustaining discharge is caused are separated in terms of time.

30. An AC type PDP drive method according to claim 26, wherein, prior to writing, wall charges with polarities opposite to each other are formed on the X electrodes and Y electrodes, respectively, and writing discharge is caused by means of erasing and writing in which the wall charges are adjusted when applying data pulses.

31. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, the same amount of wall charge being written to the X electrode and Y electrode in one pixel, and lighting and non-lighting of the pixels being controlled in accordance with the wall charge amount, wherein, prior to writing, wall charges with polarities opposite to each other are formed on the X electrodes and Y electrodes, respectively, and writing discharge is caused by means of erasing and writing in which the wall charges are adjusted when applying data pulses, and wherein wall charges with opposite polarities, which are formed on the X electrode and Y electrode, are formed by means of surface discharge between the X electrodes and Y electrodes prior to the writing.

32. An AC type PDP drive method according to claim 31, wherein the erasing and writing are caused between the X electrodes and Y electrodes.

33. An AC type PDP drive method according to claim 31, wherein wall charges with opposite polarities to be formed on the X electrodes and Y electrodes are formed when the writing is carried out into said another X electrode and Y electrode in said X electrode group and Y electrode group.

34. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, wall charges being written upon making the potentials of the X electrode and Y electrode in one pixel equal to each other, and lighting and non-lighting of the pixel being controlled in accordance with the wall charge amount, wherein, prior to writing, wall charges with polarities opposite to each other are formed on the X electrodes and Y electrodes, respectively, and writing discharge is caused by means of erasing and writing in which the wall charges are adjusted when applying data pulses, and wherein wall charges with opposite polarities, which are formed on the X electrode and Y electrode, are formed by means of surface discharge between the X electrodes and Y electrodes prior to the writing.

35. An AC type PDP drive method according to claim 34, wherein the erasing and writing are caused between the X electrodes and Y electrodes.

36. An AC type PDP drive method according to claim 34, wherein wall charges with opposite polarities to be formed on the X electrodes and Y electrodes are formed when the writing is carried out into said another X electrode and Y electrode in said X electrode group and Y electrode group.

37. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, the voltage of the wall charges being written upon making the potentials the X electrode and Y electrode in one pixel being at a level at which surface discharge does not occur between the X electrodes and Y electrodes even if the sustaining pulse voltage is added to said voltage, wherein, prior to writing, wall charges with polarities opposite to each other are formed on the X electrodes and Y electrodes, respectively, and writing discharge is caused by means of erasing and writing in which the wall charges are adjusted when applying data pulses, and wherein wall charges with opposite polarities, which are formed on the X electrode and Y electrode, are formed by means of surface discharge between the X electrodes and Y electrodes prior to the writing.

38. An AC type PDP drive method according to claim 37, wherein the erasing and writing are caused between the X electrodes and Y electrodes.

39. An AC type PDP drive method according to claim 37, wherein wall charges with opposite polarities to be formed on the X electrodes and Y electrodes are formed when the writing is carried out into said another X electrode and Y electrode in said X electrode group and Y electrode group.

40. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, the same amount of wall charge being written into the X electrode and Y electrode in one pixel, and lighting and non-lighting of the pixel being controlled in accordance with the wall charge amount, wherein, prior to writing, wall charges with polarities opposite to each other are formed on the X electrodes and Y electrodes, respectively, and writing discharge is caused by means of erasing and writing in which the wall charges are adjusted when applying data pulses, and wherein wall charges with opposite polarities, which are formed on the X electrode and Y electrode, are formed by means of surface discharge between the X electrodes and Y electrodes prior to the writing.

41. An AC type PDP drive method according to claim 40, wherein the erasing and writing are caused between the X electrodes and Y electrodes.

42. An AC type PDP drive method according to claim 40, wherein wall charges with opposite polarities to be formed on the X electrodes and Y electrodes are formed when the writing is carried out into said another X electrode and Y electrode in said X electrode group and Y electrode group.

43. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, wall charges being written upon making the potentials of the X electrodes and Y electrodes in one pixel equal to each other, and lighting and non-lighting of the pixel being controlled in accordance with the wall charge amount, wherein, prior to writing, wall charges with polarities opposite to each other are formed on the X electrodes and Y electrodes, respectively, and writing discharge is caused by means of erasing and writing in which the wall charges are adjusted when applying data pulses, and wherein wall charges with opposite polarities, which are formed on the X electrode and Y electrode, are formed by means of surface discharge between the X electrodes and Y electrodes prior to the writing.

44. An AC type PDP drive method according to claim 43, wherein the erasing and writing are caused between the X electrodes and Y electrodes.

45. An AC type PDP drive method according to claim 43, wherein wall charges with opposite polarities to be formed on the X electrodes and Y electrodes are formed when the writing is carried out into said another X electrode and Y electrode in said X electrode group and Y electrode group.

46. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, the voltage of the wall charges formed on the X electrode and Y electrode in one pixel being at a level at which surface discharge does not occur between the X electrode and Y electrode even if the voltage of the sustaining pulse is added to said voltage, wherein, prior to writing, wall charges with polarities opposite to each other are formed on the X electrodes and Y electrodes, respectively, and writing discharge is caused by means of erasing and writing in which the wall charges are adjusted when applying data pulses, and wherein wall charges with opposite polarities, which are formed on the X electrode and Y electrode, are formed by means of surface discharge between the X electrodes and Y electrodes prior to the writing.

47. An AC type PDP drive method according to claim 46, wherein the erasing and writing are caused between the X electrodes and Y electrodes.

48. An AC type PDP drive method according to claim 46, wherein wall charges with opposite polarities to be formed on the X electrodes and Y electrodes are formed when the writing is carried out into said another X electrode and Y electrode in said X electrode group and Y electrode group.

49. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, the same amount of wall charge being written into the x electrode and y electrode in one pixel, and lighting and non-lighting of the pixels being controlled in accordance with the wall charge amount, wherein sustaining discharge for display is initially started by means of opposed discharge, wherein the scanning sustaining separation method is employed in that a scanning period in which the writing is carried out and the sustaining period in which sustaining discharge is caused are separated in terms of time, and wherein wall charges with opposite polarities, which are formed on the X electrodes and Y electrodes when writing, are formed by means of surface discharge between the X electrodes and Y electrodes, and before the scanning period, the same pulse is applied to all the X electrodes and the same pulse with an opposite polarity to that of the pulse applied to the X electrodes is applied to all the Y electrodes, whereby wall charges with opposite polarities are formed on all the X electrodes and Y electrodes by a one-time pulse application.

50. An AC type PDP drive method according to claim 49, wherein, to the adjacent X electrode and Y electrode into which display data is to be written first, writing is carried out upon making the potentials of wall charges with opposite polarities to be formed on the X electrode and Y electrode to each other, and thereafter, the Y electrodes or X electrodes adjacent to the X electrodes or Y electrodes into which the writing has been already carried out are successively changed to have the same potential as the potential when writing, whereby the writing is carried out.

51. An AC type PDP drive method according to claim 50, wherein the data pulse voltage to be applied to the data electrodes when writing in the scanning period is changed in accordance with gradations to be displayed to adjust the wall charge amounts to be formed by means of writing a discharge and changes the data electrode potential in the sustaining period, whereby the sustaining discharge timing is changed in accordance with gradations and gradation display is carried out.

52. An AC type PDP drive method according to claim 51, wherein, in the sustaining period, in accordance with gradations, discharge at a sustaining discharge starting timing becomes opposed discharge between the X electrodes and data electrodes or between the Y electrodes and data electrodes.

53. An AC type PDP drive method according to claim 52, wherein the data electrodes become positive electrodes in opposed discharge.

54. An AC type PDP drive method according to claim 53, wherein the potential difference between electrodes at locations at which the opposed discharge occurs at the timing of starting the sustaining discharge is gradually increased in the sustaining period.

55. An AC type PDP drive method according to claim 54, wherein the sustaining pulse voltage is fixed, and by changing the potential of the data electrodes in the sustaining period, the potential difference between the electrodes at portions at which opposed discharge occurs at the sustaining discharge starting timing is gradually increased in the sustaining period.

56. An AC type PDP drive method according to claim 54, wherein, by changing the potential of the data electrodes in phases in the sustaining period, the potential difference between the electrodes at portions at which opposed discharge occurs at the timing of starting the sustaining discharge is gradually increased.

57. An AC type PDP drive method according to claim 56, wherein the potential of the data electrodes at timings other than the timing of starting the sustaining discharge is set to be in between the data electrode potential and sustaining pulse potential at the timing of starting the first sustaining discharge in the sustaining period.

58. An AC type PDP drive method according to claim 56, wherein the data electrode potential to be changed in phases is made common with the data pulse potential to be applied in the scanning period.

59. An AC type PDP drive method according to claim 58, wherein the preliminary discharge period in which the condition of wall charges in the sustaining period is reset, the scanning period, and the sustaining period are collectively regarded as one subfield, and a plurality of subfields are joined together to form one field for displaying one screen.

60. An AC type PDP drive method according to claim 59, wherein the sustaining pulse width at the timing of starting the sustaining discharge is larger than other sustaining pulse widths.

61. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, wall charges being written upon making the potentials of the X electrode and Y electrode in one pixel equal to each other, and lighting and non-lighting of the pixel being controlled in accordance with the wall charge amount, wherein sustaining discharge for display is initially started by means of opposed discharge, wherein the scanning sustaining separation method is employed in that a scanning period in which the writing is carried out and the sustaining period in which sustaining discharge is caused are separated in terms of time, and wherein wall charges with opposite polarities, which are formed on the X electrodes and Y electrodes when writing, are formed by means of surface discharge between the X electrodes and Y electrodes, and before the scanning period, the same pulse is applied to the X electrodes and the same pulse with an opposite polarity to that of the pulse applied to the X electrodes is applied to all the Y electrodes, whereby wall charges with opposite polarities are formed on all the X electrodes and Y electrodes by a one-time pulse application.

62. An AC type PDP drive method according to claim 61, wherein, to the adjacent X electrode and Y electrode into which display data is to be written first, writing is carried out upon making the potentials of wall charges with opposite polarities to be formed on the X electrode and Y electrode to each other, and thereafter, the Y electrodes or X electrodes adjacent to the X electrodes or Y electrodes into which the writing has been already carried out are successively changed to have the same potential as the potential when writing, whereby the writing is carried out.

63. An AC type PDP drive method according to claim 62, wherein the data pulse voltage to be applied to the data electrodes when writing in the scanning period is changed in accordance with gradations to be displayed to adjust the wall charge amounts to be formed by means of writing a discharge and changes the data electrode potential in the sustaining period, whereby the sustaining discharge timing is changed in accordance with gradations and gradation display is carried out.

64. An AC type PDP drive method according to claim 63, wherein, in the sustaining period, in accordance with gradations, discharge at a sustaining discharge starting timing becomes opposed discharge between the X electrodes and data electrodes or between the Y electrodes and data electrodes.

65. An AC type PDP drive method according to claim 64, wherein the data electrodes become positive electrodes in opposed discharge.

66. An AC type PDP drive method according to claim 65, wherein the potential difference between electrodes at locations at which the opposed discharge occurs at the timing of starting the sustaining discharge is gradually increased in the sustaining period.

67. An AC type PDP drive method according to claim 66, wherein the sustaining pulse voltage is fixed, and by changing the potential of the data electrodes in the sustaining period, the potential difference between the electrodes at portions at which opposed discharge occurs at the sustaining discharge starting timing is gradually increased in the sustaining period.

68. An AC type PDP drive method according to claim 66, wherein, by changing the potential of the data electrodes in phases in the sustaining period, the potential difference between the electrodes at portions at which opposed discharge occurs at the timing of starting the sustaining discharge is gradually increased.

69. An AC type PDP drive method according to claim 68, wherein the potential of the data electrodes at timings other than the timing of starting the sustaining discharge is set to be in between the data electrode potential and sustaining pulse potential at the timing of starting the first sustaining discharge in the sustaining period.

70. An AC type PDP drive method according to claim 68, wherein the data electrode potential to be changed in phases is made common with the data pulse potential to be applied in the scanning period.

71. An AC type PDP drive method according to claim 70, wherein the preliminary discharge period in which the condition of wall charges in the sustaining period is reset, the scanning period, and the sustaining period are collectively regarded as one subfield, and a plurality of subfields are joined together to form one field for displaying one screen.

72. An AC type PDP drive method according to claim 71, wherein the sustaining pulse width at the timing of starting the sustaining discharge is larger than other sustaining pulse widths.

73. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and a gap between the X electrode and a Y electrode adjacent to the other side of the X electrode is formed as a non-discharge gap, pixels arranged in a matrix form are formed at intersections between the discharge gaps and data electrodes, and every several X electrodes and every several Y electrodes are made to share a driver each, said method comprising a step of writing to the pixels to form wall charges based on display data, the voltage of the wall charges formed on the X electrode and Y electrode in one pixel being at a level at which surface discharge does not occur between the X electrodes and Y electrodes even if the sustaining pulse is added to said voltage, wherein sustaining discharge for display is initially started by means of opposed discharge, wherein the scanning sustaining separation method is employed in that a scanning period in which the writing is carried out and the sustaining period in which sustaining discharge is caused are separated in terms of time, and wherein wall charges with opposite polarities, which are formed on the X electrodes and Y electrodes when writing, are formed by means of surface discharge between the X electrodes and Y electrodes, and before the scanning period, the same pulse is applied to all the X electrodes and the same pulse with an opposite polarity to that of the pulse applied to the X electrodes is applied to all the Y electrodes, whereby wall charges with opposite polarities are formed on all the X electrodes and Y electrodes by a one-time pulse application.

74. An AC type PDP drive method according to claim 73, wherein, to the adjacent X electrode and Y electrode into which display data is to be written first, writing is carried out upon making the potentials of wall charges with opposite polarities to be formed on the X electrode and Y electrode to each other, and thereafter, the Y electrodes or X electrodes adjacent to the X electrodes or Y electrodes into which the writing has been already carried out are successively changed to have the same potential as the potential when writing, whereby the writing is carried out.

75. An AC type PDP drive method according to claim 74, wherein the data pulse voltage to be applied to the data electrodes when writing in the scanning period is changed in accordance with gradations to be displayed to adjust the wall charge amounts to be formed by means of writing a discharge and changes the data electrode potential in the sustaining period, whereby the sustaining discharge timing is changed in accordance with gradations and gradation display is carried out.

76. An AC type PDP drive method according to claim 75, wherein, in the sustaining period, in accordance with gradations, discharge at a sustaining discharge starting timing becomes opposed discharge between the X electrodes and data electrodes or between the Y electrodes and data electrodes.

77. An AC type PDP drive method according to claim 76, wherein the data electrodes become positive electrodes in opposed discharge.

78. An AC type PDP drive method according to claim 77, wherein the potential difference between electrodes at locations at which the opposed discharge occurs at the timing of starting the sustaining discharge is gradually increased in the sustaining period.

79. An AC type PDP drive method according to claim 78, wherein the sustaining pulse voltage is fixed, and by changing the potential of the data electrodes in the sustaining period, the potential difference between the electrodes at portions at which opposed discharge occurs at the sustaining discharge starting timing is gradually increased in the sustaining period.

80. An AC type PDP drive method according to claim 78, wherein, by changing the potential of the data electrodes in phases in the sustaining period, the potential difference between the electrodes at portions at which opposed discharge occurs at the timing of starting the sustaining discharge is gradually increased.

81. An AC type PDP drive method according to claim 80, wherein the potential of the data electrodes at timings other than the timing of starting the sustaining discharge is set to be in between the data electrode potential and sustaining pulse potential at the timing of starting the first sustaining discharge in the sustaining period.

82. An AC type PDP drive method according to claim 80, wherein the data electrode potential to be changed in phases is made common with the data pulse potential to be applied in the scanning period.

83. An AC type PDP drive method according to claim 82, wherein the preliminary discharge period in which the condition of wall charges in the sustaining period is reset, the scanning period, and the sustaining period are collectively regarded as one subfield, and a plurality of subfields are joined together to form one field for displaying one screen.

84. An AC type PDP drive method according to claim 83, wherein the sustaining pulse width at the timing of starting the sustaining discharge is larger than other sustaining pulse widths.

85. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, a gap between one X electrode and a Y electrode adjacent to one side of the X electrode is formed as a discharge gap, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, the same amount of wall charge being written into the X electrode and Y electrode in one pixel, and lighting and non-lighting of the pixel being controlled in accordance with the wall charge amount, wherein sustaining discharge for display is initially started by means of opposed discharge, wherein the scanning sustaining separation method is employed in that a scanning period in which the writing is carried out and the sustaining period in which sustaining discharge is caused are separated in terms of time, and wherein wall charges with opposite polarities, which are formed on the X electrodes and Y electrodes when writing, are formed by means of surface discharge between the X electrodes and Y electrodes, and before the scanning period, the same pulse is applied to all the X electrodes and the same pulse with an opposite polarity to that of the pulse applied to the X electrodes is applied to all the Y electrodes, whereby wall charges with opposite polarities are formed on all the X electrodes and Y electrodes by a one-time pulse application.

86. An AC type PDP drive method according to claim 85, wherein, to the adjacent X electrode and Y electrode into which display data is to be written first, writing is carried out upon making the potentials of wall charges with opposite polarities to be formed on the X electrode and Y electrode to each other, and thereafter, the Y electrodes or X electrodes adjacent to the X electrodes or Y electrodes into which the writing has been already carried out are successively changed to have the same potential as the potential when writing, whereby the writing is carried out.

87. An AC type PDP drive method according to claim 86, wherein the data pulse voltage to be applied to the data electrodes when writing in the scanning period is changed in accordance with gradations to be displayed to adjust the wall charge amounts to be formed by means of writing a discharge and changes the data electrode potential in the sustaining period, whereby the sustaining discharge timing is changed in accordance with gradations and gradation display is carried out.

88. An AC type PDP drive method according to claim 87, wherein, in the sustaining period, in accordance with gradations, discharge at a sustaining discharge starting timing becomes opposed discharge between the X electrodes and data electrodes or between the Y electrodes and data electrodes.

89. An AC type PDP drive method according to claim 88, wherein the data electrodes become positive electrodes in opposed discharge.

90. An AC type PDP drive method according to claim 89, wherein the potential difference between electrodes at locations at which the opposed discharge occurs at the timing of starting the sustaining discharge is gradually increased in the sustaining period.

91. An AC type PDP drive method according to claim 90, wherein the sustaining pulse voltage is fixed, and by changing the potential of the data electrodes in the sustaining period, the potential difference between the electrodes at portions at which opposed discharge occurs at the sustaining discharge starting timing is gradually increased in the sustaining period.

92. An AC type PDP drive method according to claim 90, wherein, by changing the potential of the data electrodes in phases in the sustaining period, the potential difference between the electrodes at portions at which opposed discharge occurs at the timing of starting the sustaining discharge is gradually increased.

93. An AC type PDP drive method according to claim 92, wherein the potential of the data electrodes at timings other than the timing of starting the sustaining discharge is set to be in between the data electrode potential and sustaining pulse potential at the timing of starting the first sustaining discharge in the sustaining period.

94. An AC type PDP drive method according to claim 92, wherein the data electrode potential to be changed in phases is made common with the data pulse potential to be applied in the scanning period.

95. An AC type PDP drive method according to claim 94, wherein the preliminary discharge period in which the condition of wall charges in the sustaining period is reset, the scanning period, and the sustaining period are collectively regarded as one subfield, and a plurality of subfields are joined together to form one field for displaying one screen.

96. An AC type PDP drive method according to claim 95, wherein the sustaining pulse width at the timing of starting the sustaining discharge is larger than other sustaining pulse widths.

97. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, and all gaps between the X electrodes and Y electrodes are formed as discharge gaps, pixels arranged in a matrix form are formed at intersections between the discharge gaps and data electrodes, and means for dividing surface discharge occurring between the X electrodes Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, wall charges being written upon making the potentials of the X electrode and Y electrode in one pixel equal to each other, and lighting and non-lighting of the pixel being controlled in accordance with the wall charge amount, wherein sustaining discharge for display is initially started by means of opposed discharge, wherein the scanning sustaining separation method is employed in that a scanning period in which the writing is carried out and the sustaining period in which sustaining discharge is caused are separated in terms of time, and wherein wall charges with opposite polarities, which are formed on the X electrodes and Y electrodes when writing, are formed by means of surface discharge between the X electrodes and Y electrodes, and before the scanning period, the same pulse is applied to all the X electrodes and the same pulse with an opposite polarity to that of the pulse applied to the X electrodes is applied to all the Y electrodes, whereby wall charges with opposite polarities are formed on all the X electrodes and Y electrodes by a one-time pulse application.

98. An AC type PDP drive method according to claim 97, wherein, to the adjacent X electrode and Y electrode into which display data is to be written first, writing is carried out upon making the potentials of wall charges with opposite polarities to be formed on the X electrode and Y electrode to each other, and thereafter, the Y electrodes or X electrodes adjacent to the X electrodes or Y electrodes into which the writing has been already carried out are successively changed to have the same potential as the potential when writing, whereby the writing is carried out.

99. An AC type PDP drive method according to claim 98, wherein the data pulse voltage to be applied to the data electrodes when writing in the scanning period is changed in accordance with gradations to be displayed to adjust the wall charge amounts to be formed by means of writing a discharge and changes the data electrode potential in the sustaining period, whereby the sustaining discharge timing is changed in accordance with gradations and gradation display is carried out.

100. An AC type PDP drive method according to claim 99, wherein, in the sustaining period, in accordance with gradations, discharge at a sustaining discharge starting timing becomes opposed discharge between the X electrodes and data electrodes or between the Y electrodes and data electrodes.

101. An AC type PDP drive method according to claim 100, wherein the data electrodes become positive electrodes in opposed discharge.

102. An AC type PDP drive method according to claim 101, wherein the potential difference between electrodes at locations at which the opposed discharge occurs at the timing of starting the sustaining discharge is gradually increased in the sustaining period.

103. An AC type PDP drive method according to claim 102, wherein the sustaining pulse voltage is fixed, and by changing the potential of the data electrodes in the sustaining period, the potential difference between the electrodes at portions at which opposed discharge occurs at the sustaining discharge starting timing is gradually increased in the sustaining period.

104. An AC type PDP drive method according to claim 102, wherein, by changing the potential of the data electrodes in phases in the sustaining period, the potential difference between the electrodes at portions at which opposed discharge occurs at the timing of starting the sustaining discharge is gradually increased.

105. An AC type PDP drive method according to claim 104, wherein the potential of the data electrodes at timings other than the timing of starting the sustaining discharge is set to be in between the data electrode potential and sustaining pulse potential at the timing of starting the first sustaining discharge in the sustaining period.

106. An AC type PDP drive method according to claim 104, wherein the data electrode potential to be changed in phases is made common with the data pulse potential to be applied in the scanning period.

107. An AC type PDP drive method according to claim 106, wherein the preliminary discharge period in which the condition of wall charges in the sustaining period is reset, the scanning period, and the sustaining period are collectively regarded as one subfield, and a plurality of subfields are joined together to form one field for displaying one screen.

108. An AC type PDP drive method according to claim 107, wherein the sustaining pulse width at the timing of starting the sustaining discharge is larger than other sustaining pulse widths.

109. An AC type plasma display panel (PDP) drive method, in which a plurality of X electrodes and a plurality of Y electrodes are alternately disposed in parallel to each other on one of two insulating substrates opposed to each other, a plurality of data electrodes are disposed on the other insulating substrate so as to be orthogonal to the X electrodes and Y electrodes, and all gaps between the X electrodes and Y electrodes are formed as discharge gaps, pixels arranged in a matrix form are formed at intersections between the discharge gaps and data electrodes, and means for dividing surface discharge occurring between the X electrodes and Y electrodes are provided at the boundaries between the pixels and the adjacent pixels in the data electrode direction on the X electrodes and Y electrodes, and either every several X electrodes or Y electrodes are made to share a driver, said method comprising a step of writing to the pixels to form wall charges based on display data, the voltage of the wall charges formed on the X electrode and Y electrode in one pixel being at a level at which surface discharge does not occur between the X electrode and Y electrode even if the voltage of the sustaining pulse is added to said voltage, wherein sustaining discharge for display is initially started by means of opposed discharge, wherein the scanning sustaining separation method is employed in that a scanning period in which the writing is carried out and the sustaining period in which sustaining discharge is caused are separated in terms of time, and wherein wall charges with opposite polarities, which are formed on the X electrodes and Y electrodes when writing, are formed by means of surface discharge between the X electrodes and Y electrodes, and before the scanning period, the same pulse is applied to all the X electrodes and the same pulse with an opposite polarity to that of the pulse applied to the X electrodes is applied to all the Y electrodes, whereby wall charges with opposite polarities are formed on all the X electrodes and Y electrodes by a one-time pulse application.

110. An AC type PDP drive method according to claim 109, wherein, to the adjacent X electrode and Y electrode into which display data is to be written first, writing is carried out upon making the potentials of wall charges with opposite polarities to be formed on the X electrode and Y electrode to each other, and thereafter, the Y electrodes or X electrodes adjacent to the X electrodes or Y electrodes into which the writing has been already carried out are successively changed to have the same potential as the potential when writing, whereby the writing is carried out.

111. An AC type PDP drive method according to claim 110, wherein the data pulse voltage to be applied to the data electrodes when writing in the scanning period is changed in accordance with gradations to be displayed to adjust the wall charge amounts to be formed by means of writing a discharge and changes the data electrode potential in the sustaining period, whereby the sustaining discharge timing is changed in accordance with gradations and gradation display is carried out.

112. An AC type PDP drive method according to claim 111, wherein, in the sustaining period, in accordance with gradations, discharge at a sustaining discharge starting timing becomes opposed discharge between the X electrodes and data electrodes or between the Y electrodes and data electrodes.

113. An AC type PDP drive method according to claim 112, wherein the data electrodes become positive electrodes in opposed discharge.

114. An AC type PDP drive method according to claim 113, wherein the potential difference between electrodes at locations at which the opposed discharge occurs at the timing of starting the sustaining discharge is gradually increased in the sustaining period.

115. An AC type PDP drive method according to claim 114, wherein the sustaining pulse voltage is fixed, and by changing the potential of the data electrodes in the sustaining period, the potential difference between the electrodes at portions at which opposed discharge occurs at the sustaining discharge starting timing is gradually increased in the sustaining period.

116. An AC type PDP drive method according to claim 114, wherein, by changing the potential of the data electrodes in phases in the sustaining period, the potential difference between the electrodes at portions at which opposed discharge occurs at the timing of starting the sustaining discharge is gradually increased.

117. An AC type PDP drive method according to claim 116, wherein the potential of the data electrodes at timings other than the timing of starting the sustaining discharge is set to be in between the data electrode potential and sustaining pulse potential at the timing of starting the first sustaining discharge in the sustaining period.

118. An AC type PDP drive method according to claim 116, wherein the data electrode potential to be changed in phases is made common with the data pulse potential to be applied in the scanning period.

119. An AC type PDP drive method according to claim 118, wherein the preliminary discharge period in which the condition of wall charges in the sustaining period is reset, the scanning period, and the sustaining period are collectively regarded as one subfield, and a plurality of subfields are joined together to form one field for displaying one screen.

120. An AC type PDP drive method according to claim 119, wherein the sustaining pulse width at the timing of starting the sustaining discharge is larger than other sustaining pulse widths.

121. An AC type plasma display panel (PDP) comprising:

a plurality of X electrodes and a plurality of Y electrodes being alternately disposed in parallel to each other on one of two insulating substrates opposed to each other, at least either every several X electrodes or Y electrodes being made to share a driver;

a plurality of data electrodes disposed in parallel to each other on the other insulating substrate so as to be orthogonal to the X electrodes and Y electrodes, all gaps between the X electrodes and Y electrodes being formed to be discharge gaps;

pixels arranged in a matrix form and formed at intersections between the discharge gaps and data electrodes; and cell partitions provided on the insulating substrate with the X electrodes and Y electrodes so as to be on the X electrodes and Y electrodes, for dividing surface discharge occurring between the X electrodes and Y electrodes, said cell partitions being provided at the boundaries between the electrodes and adjacent pixels in the data electrode direction on the X electrodes and Y electrodes, wherein the X electrodes and Y electrodes are formed of transparent electrodes formed on the insulating substrate, and metal electrodes whose widths are smaller than that of the transparent electrodes are provided on these transparent electrodes, wherein the cell partitions are disposed at positions opposed to the metal electrodes, and wherein data side cell partitions are also provided on the insulating substrate with the data electrodes at positions opposed to the cell partitions.

122. An AC type PDP according to claim 121, wherein the cell partitions and data side cell partitions are separated in the cells.

123. An AC type PDP according to claim 122, wherein the widths of the data electrodes opposed to the cell partitions are smaller than the widths of the data electrodes at the positions opposed to the X electrodes and Y electrodes.

124. An AC type PDP according to claim 123, wherein stripe partitions are provided between the adjacent data electrodes to divide pixels.

125. An AC type PDP according to claim 124, wherein the data electrodes at the positions opposed to the cell partitions are positioned below the stripe partitions.

* * * * *